US011851140B1

(12) United States Patent
Schirmang

(10) Patent No.: US 11,851,140 B1
(45) Date of Patent: Dec. 26, 2023

(54) CROSS-COUNTRY WATER SKIS

(71) Applicant: Michael Anton Schirmang, Cincinnati, OH (US)

(72) Inventor: Michael Anton Schirmang, Cincinnati, OH (US)

( * ) Notice: Subject to any disclaimer, the term of this patent is extended or adjusted under 35 U.S.C. 154(b) by 0 days.

(21) Appl. No.: 18/090,221

(22) Filed: Dec. 28, 2022

Related U.S. Application Data

(60) Provisional application No. 63/403,482, filed on Sep. 2, 2022.

(51) Int. Cl.
*B63B 32/30* (2020.01)
*B63H 16/04* (2006.01)

(52) U.S. Cl.
CPC ..... *B63B 32/35* (2020.02); *B63H 16/04* (2013.01)

(58) Field of Classification Search
CPC ..... B63B 32/35; B63H 16/04
See application file for complete search history.

(56) References Cited

U.S. PATENT DOCUMENTS 2,153,939 A * 4/1939 Schaupp ..... B63B 34/56 441/77
2,412,474 A * 12/1946 Scott-Paine ..... A63C 1/00 114/65 R
3,031,696 A 5/1962 Brabb
3,063,071 A * 11/1962 Van Vorst ..... B63B 34/56 441/77
3,121,892 A * 2/1964 Plumlee ..... B63B 34/56 441/77
3,835,494 A * 9/1974 Dougherty ..... B63B 34/56 D21/422
3,952,353 A 4/1976 Word
4,034,430 A 7/1977 Joyce
4,068,610 A * 1/1978 Tesan ..... B63B 32/70 280/821
4,157,597 A * 6/1979 Trebnick ..... B63B 34/56 441/76
4,261,069 A 4/1981 Schaumann
(Continued)

OTHER PUBLICATIONS

International Search Report and Written Opinion dated Oct. 6, 2023 in related International Application No. PCT/US2023/031827 filed Sep. 1, 2023 (7 pages).

*Primary Examiner* — S. Joseph Morano
*Assistant Examiner* — Jovon E Hayes
(74) *Attorney, Agent, or Firm* — Ronald J. Richter; Nesbitt IP LLC

(57) ABSTRACT

Water walking skis and a method for boarding them, in which each ski has an elongated body with a bow end in the form of a monohull and a stern end in the form of a twin hull. The skis can be combined with a pair of poles for balance, and binding straps for binding the skis and poles together while boarding/reboarding. The deck of each ski typically has a recessed area for foot placement, and two parallel side extensions protrude downward from the deck. The side extensions, the deck, and an underside or bottom cover together form a tunnel within the ski, the tunnel having a screen-covered first opening for admitting water and a rear opening for expelling water. Traction gates are mounted within the tunnel and spaced apart therein for permitting water flow therethrough when the ski moves forward, while preventing water flow when moving in the reverse direction.

19 Claims, 29 Drawing Sheets

(56) References Cited

U.S. PATENT DOCUMENTS

| | | | | | |
|---|---|---|---|---|---|
| 4,379,701 | A | | 4/1983 | David | |
| 4,527,984 | A | | 7/1985 | Gilbert | |
| 4,952,184 | A | * | 8/1990 | Graziano | B63B 34/56 441/77 |
| 5,593,334 | A | * | 1/1997 | Thayer | B63B 34/56 441/76 |
| 5,697,822 | A | * | 12/1997 | Souter | B63H 16/08 441/76 |
| 6,855,024 | B2 | * | 2/2005 | Rothschild | B63B 34/56 441/77 |
| 7,361,071 | B1 | * | 4/2008 | Lauren | B63B 34/56 441/76 |
| 7,607,959 | B2 | * | 10/2009 | DeMint | B63B 34/565 441/76 |
| 9,290,244 | B2 | | 3/2016 | Souter | |
| 9,611,019 | B2 | | 4/2017 | Spencer | |
| 10,472,027 | B1 | * | 11/2019 | Croft | B63B 34/56 |
| 10,926,849 | B1 | | 2/2021 | Orth | |
| 11,208,178 | B2 | * | 12/2021 | Orth | B63B 34/565 |
| 2003/0203686 | A1 | * | 10/2003 | Rothschild | B63B 34/56 441/76 |
| 2021/0339833 | A1 | * | 11/2021 | Orth | B63B 32/35 |

* cited by examiner

FIG. 14
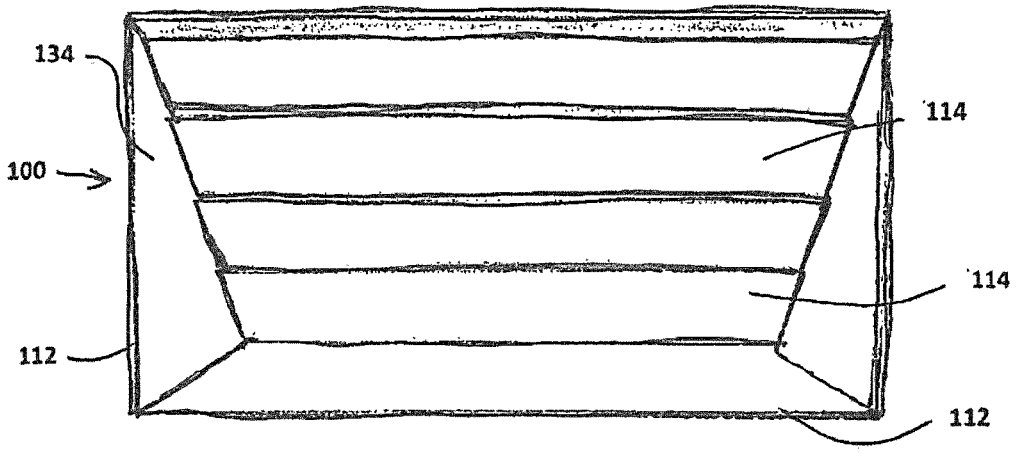
FIG. 15
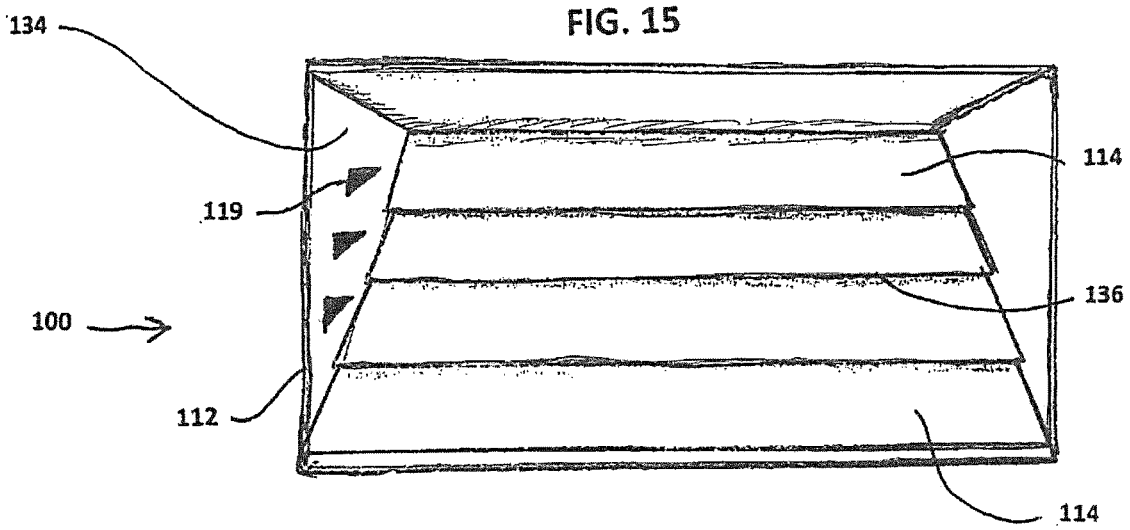
FIG. 16
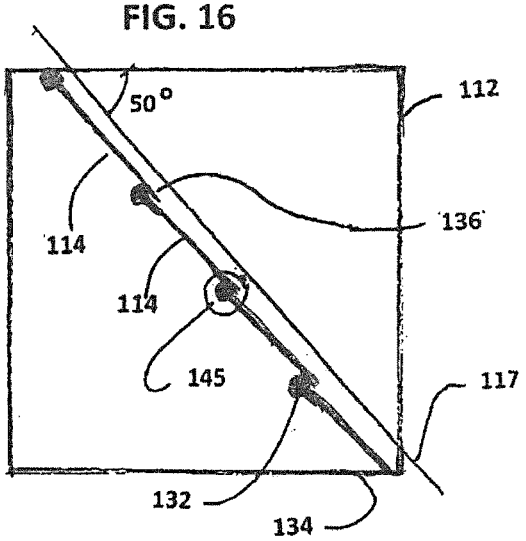
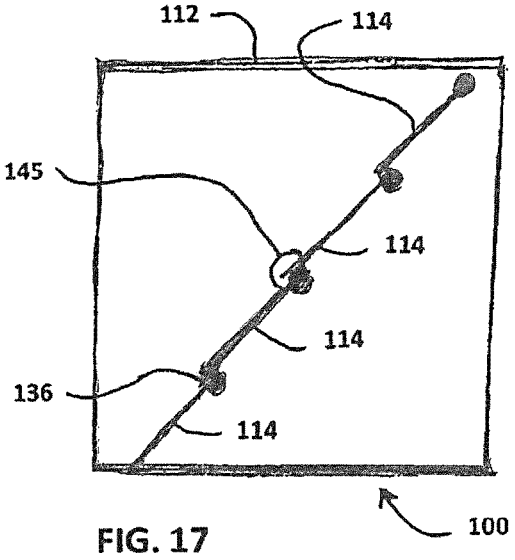
FIG. 17

FIG. 18
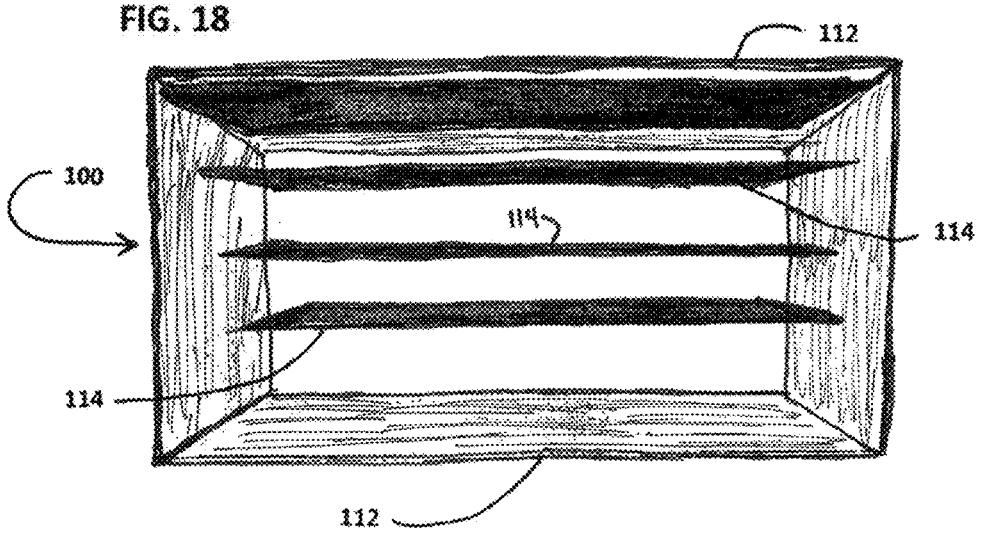
FIG. 19
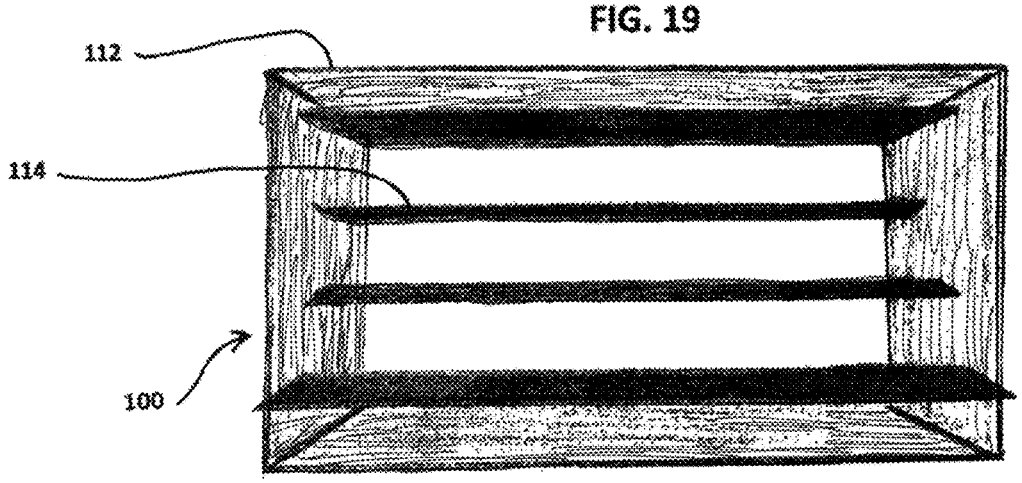
FIG. 20
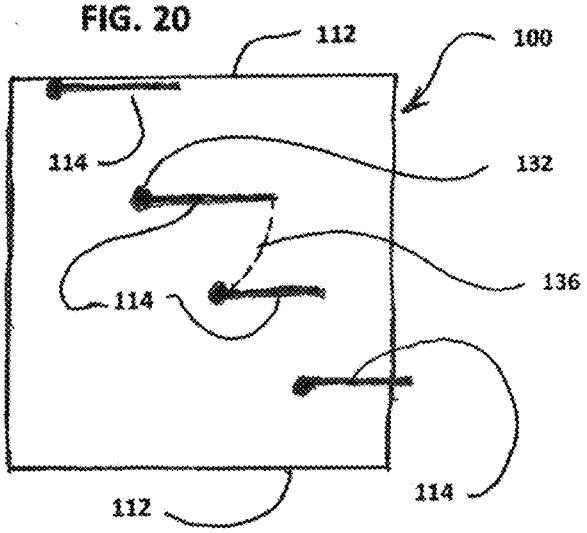
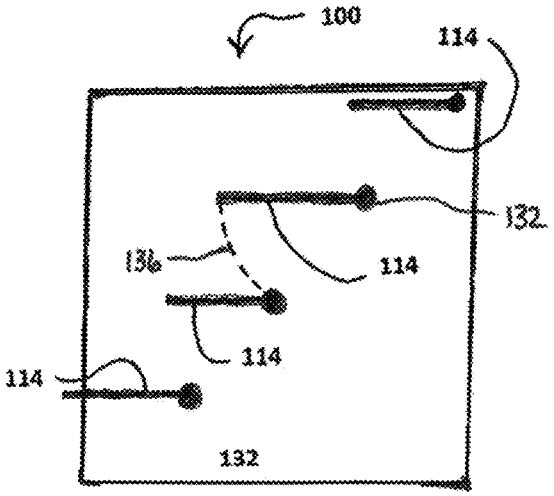
FIG. 21

FIG. 26
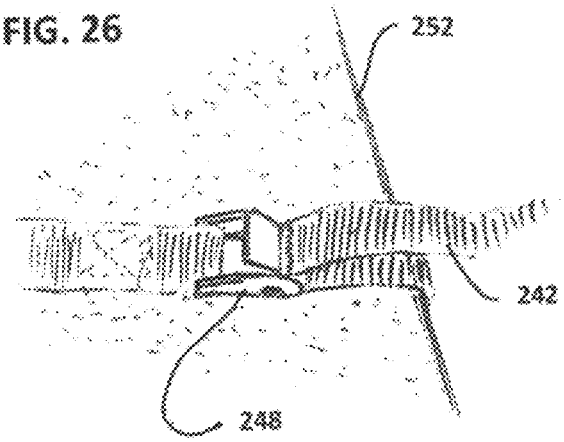
FIG. 27
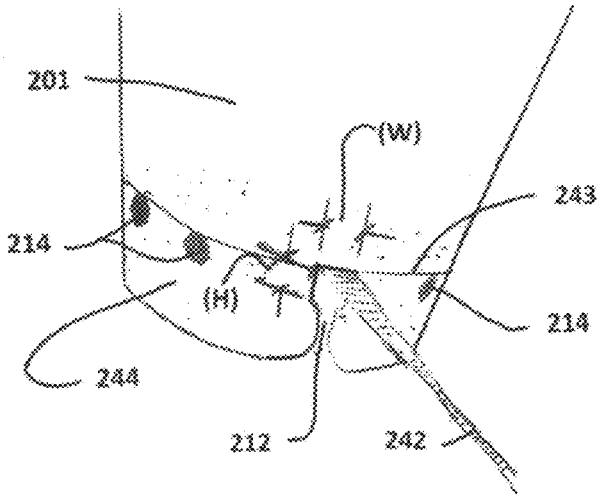
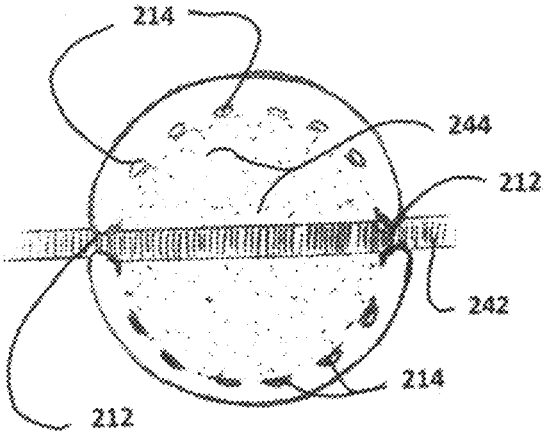
FIG. 28

FIG. 30
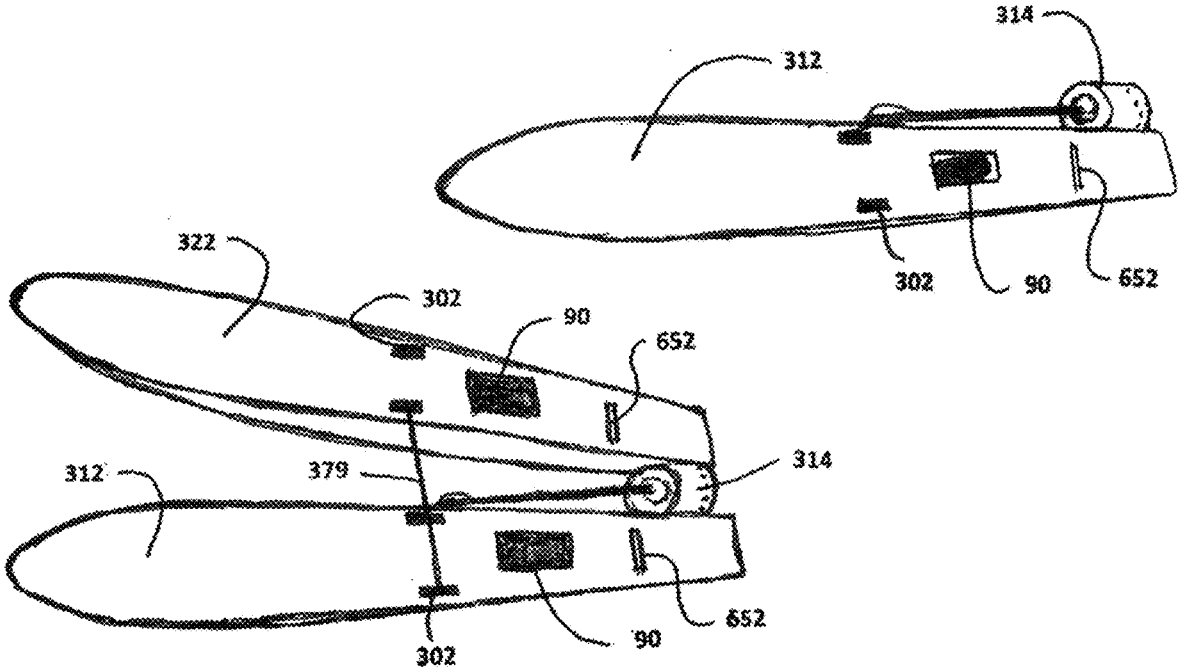
FIG. 31
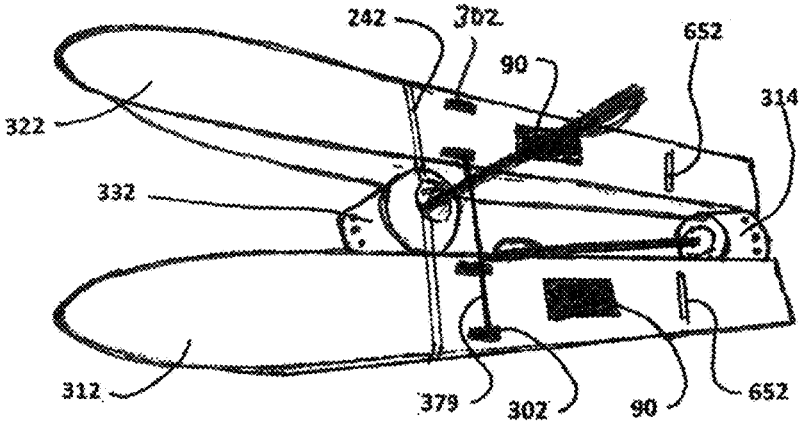
FIG. 32

FIG. 33
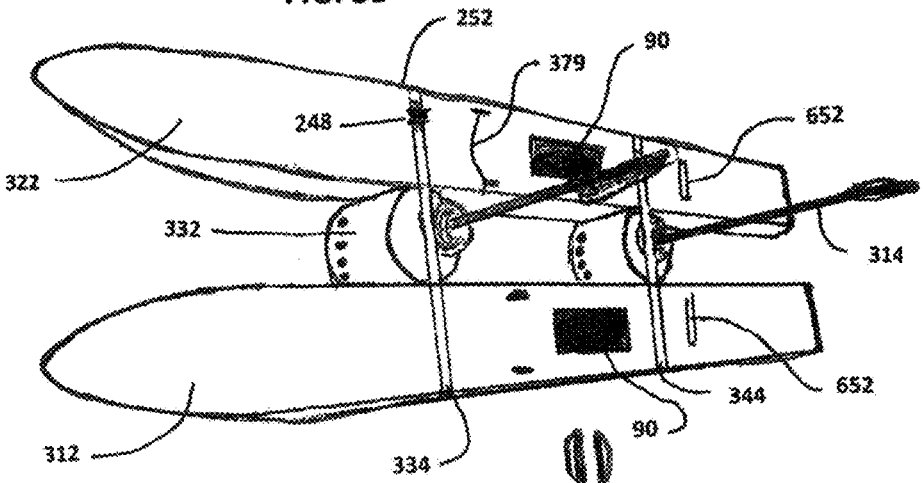
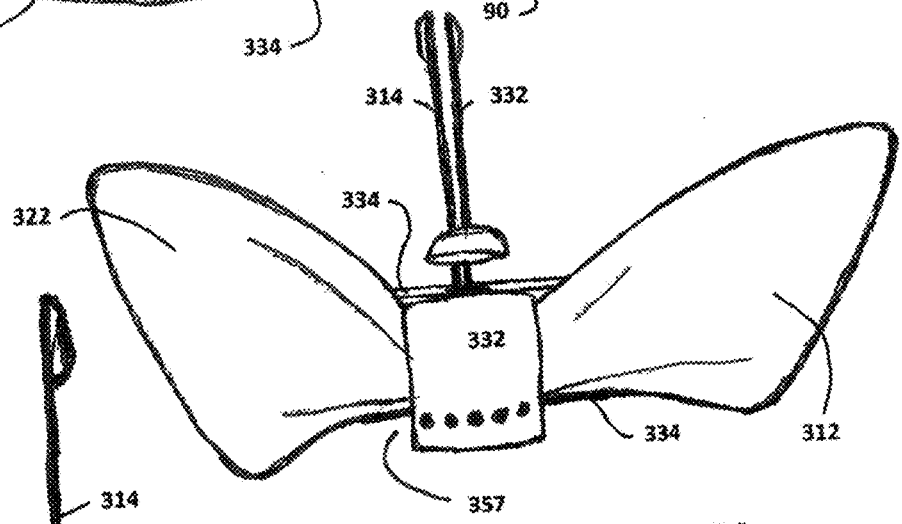
FIG. 34
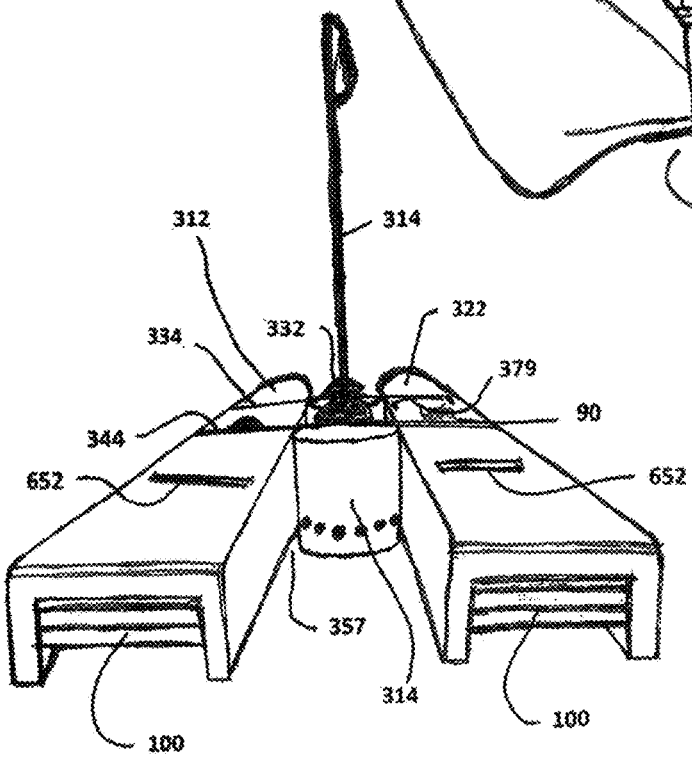
FIG. 35

FIG. 36
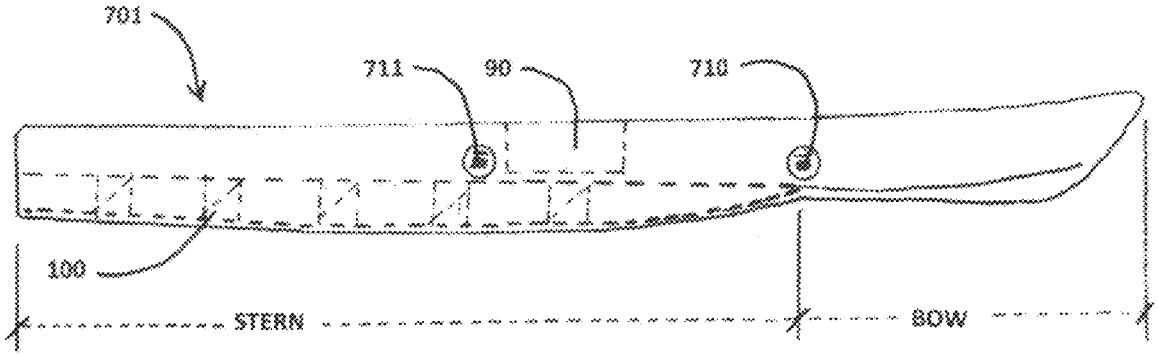
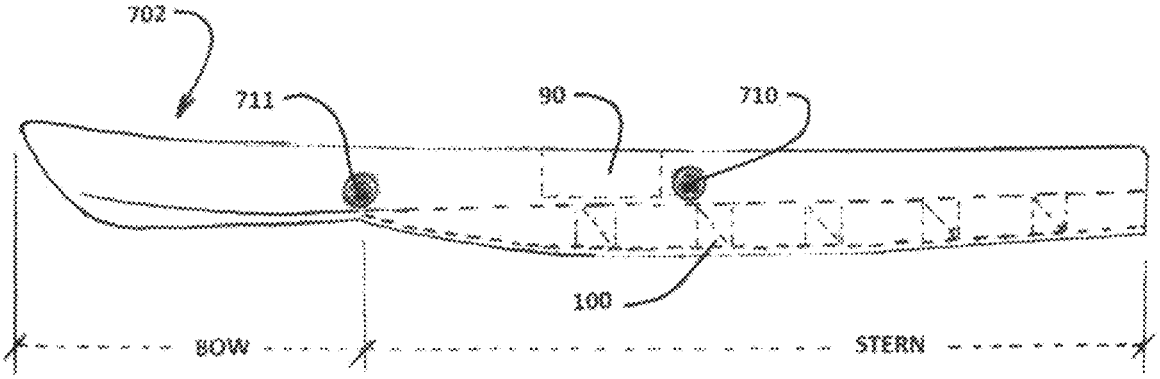
FIG. 37

FIG. 42
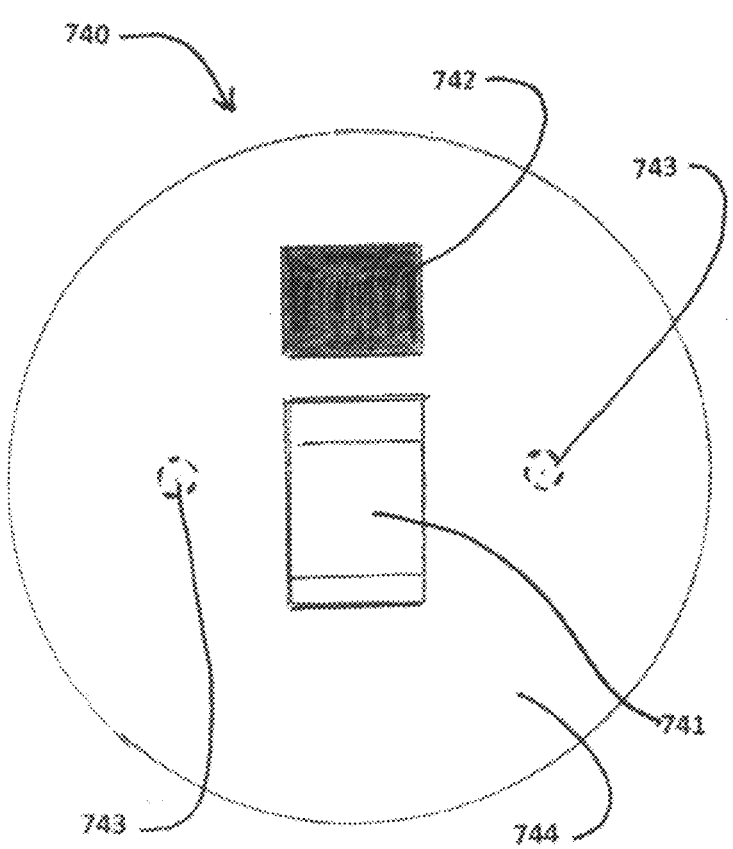
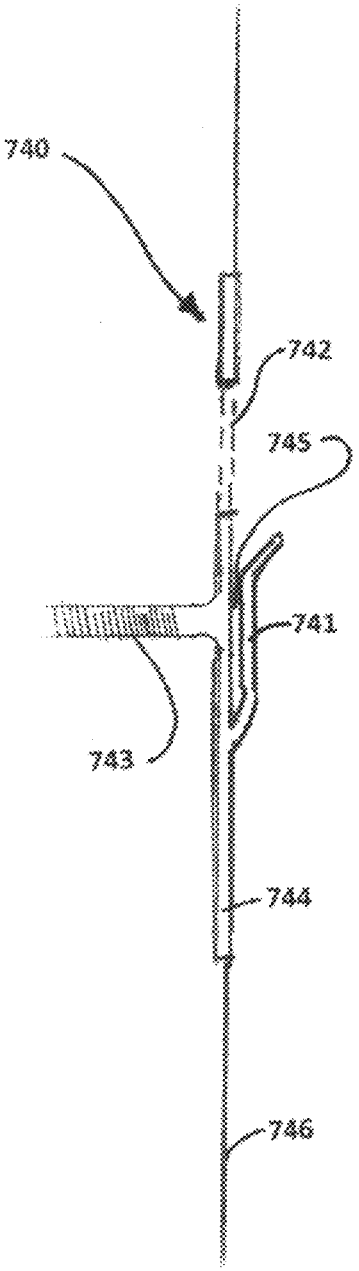
FIG. 43

FIG. 52
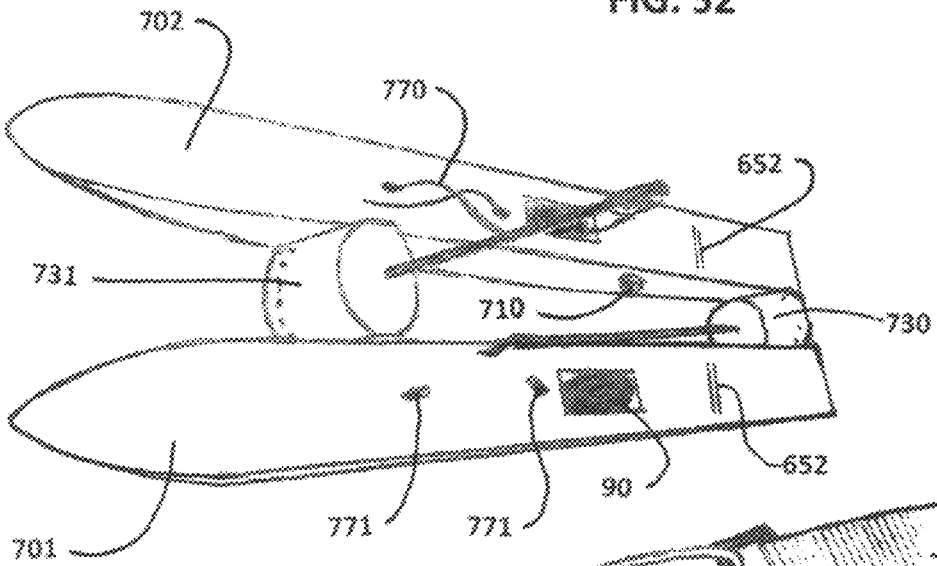
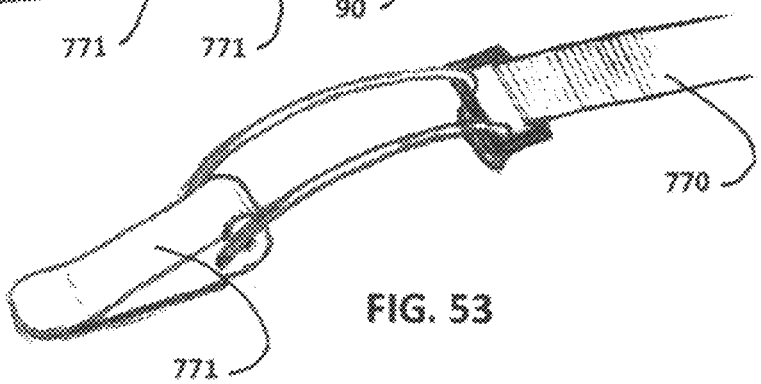
FIG. 53
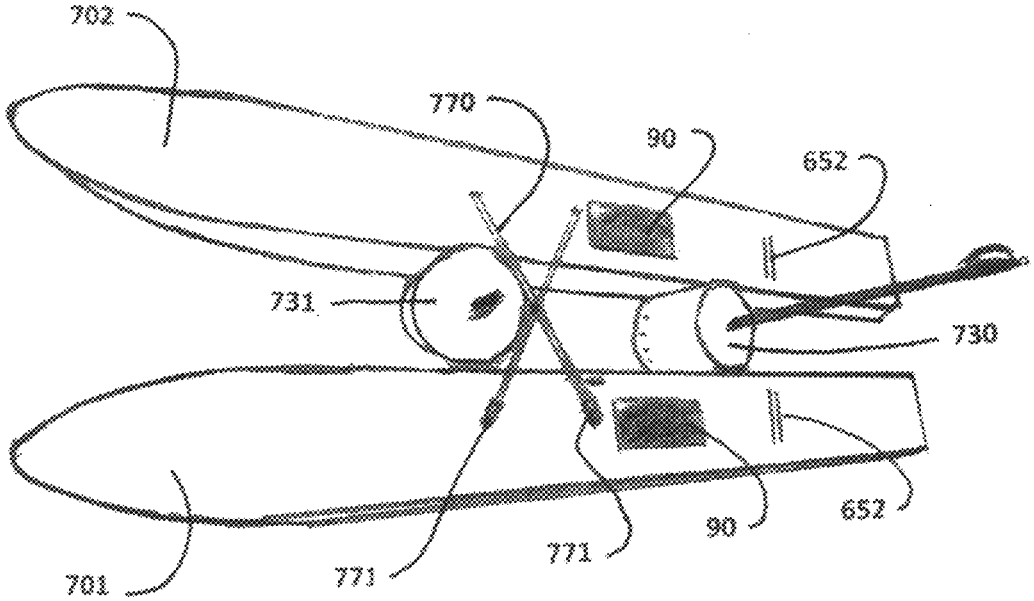
FIG. 54

FIG. 58
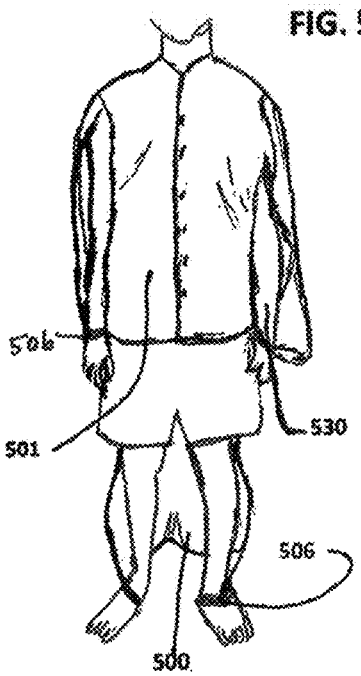
FIG. 59
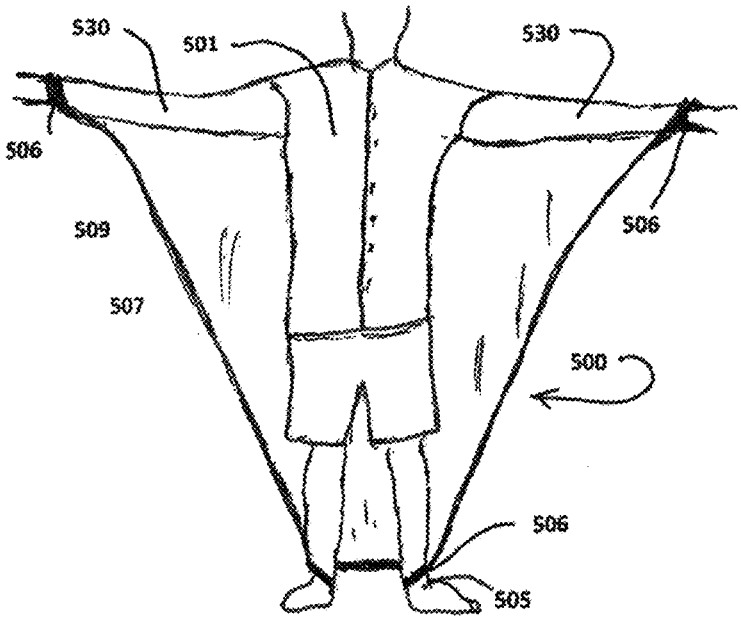
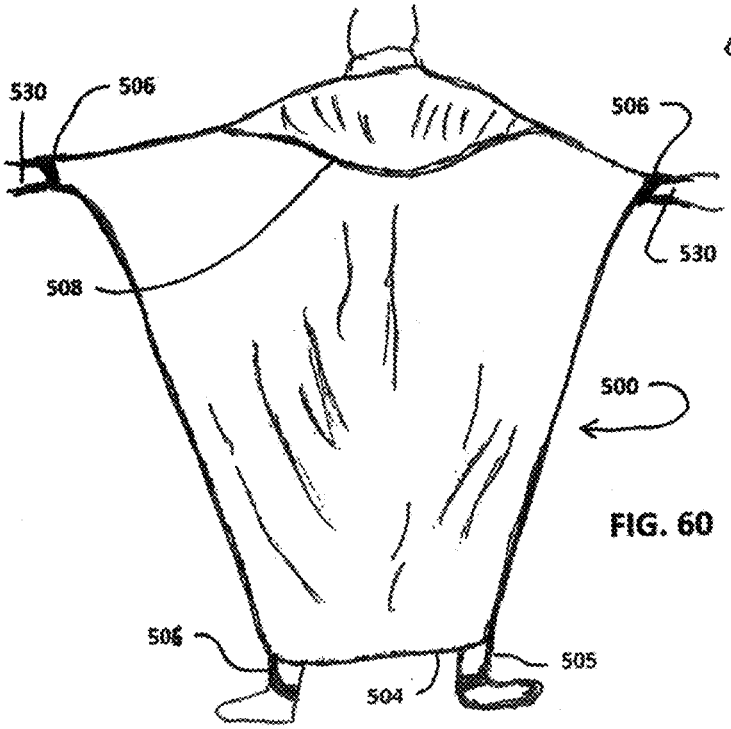
FIG. 60

CROSS-COUNTRY WATER SKIS

CROSS-REFERENCE TO RELATED APPLICATION

This application claims the benefit of U.S. Provisional Application No. 63/403,482 filed Sep. 2, 2022, the disclosure of which is herein incorporated by reference in its entirety.

FIELD OF THE INVENTION

The present invention relates generally to recreational water sports equipment, and more specifically to manually powered water walking skis with improved means for traveling across the water.

BACKGROUND OF THE INVENTION

Water walking devices, typically in the form of a pair of individual buoyant pontoons and referred to as water walkers, water shoes, or water skis, have been known for a considerable period of time and have taken many forms. Such devices are typically used in combination with hand-held poles for balancing and stabilizing them against lateral drift and pitch, and for assisting in propulsion. Nevertheless, prior art water walking devices have generally proven unsatisfactory due to various problems, such as inadequate control and instability. For example, since there is a natural tendency for the individual skis to drift apart, the user often loses control of them, either falling or sliding backwards while attempting to "walk" forward along the water. Further, in the event that the user of a prior water walking device capsizes or otherwise loses the skis while in the water, it is typically extremely difficult to reboard or remount in the water. In addition, previous attempts at providing an efficient propulsion means, such as the use of water gripping elements to provide traction, have been inefficient and ultimately unsuccessful. As a result, the typical travel speed along the water with these devices is very slow, and users become quickly fatigued.

In light of the above discussion, it is apparent that there is a need for an improved water walking device which can provide better stability and control. It would also be beneficial to provide a pair of water walking skis which allow the user to engage in efficient, self-propelled travel across the water by moving in a similar manner as cross-country snow skiing. It would also be useful to provide a more efficient water walking ski with improved speed. It would also be beneficial to provide a pair of water walking skis which enable the user to travel a long distance without becoming fatigued. It would also be advantageous to provide an improved water walking ski which is comparatively simple in construction, durable, light in weight, and can be manufactured at low cost.

SUMMARY OF THE INVENTION

Accordingly, the present invention provides an improved water walking apparatus as described substantially herein for use as cross-country water skis.

One aspect of the invention provides a water walking ski comprising: an elongated body having a bow end in the form of a monohull and a stern end in the form of a twin hull, the elongated body further including a top deck and a recessed area for foot placement within the top deck; two parallel side extensions which protrude downward from the top deck; a bottom cover located beneath the top deck and between the parallel side extensions, wherein the top deck, the side extensions, and the bottom cover together form a tunnel, the tunnel including a first opening near the bow end for admitting water and a second opening near the stern end for expelling water; and a plurality of traction gates mounted within the tunnel, wherein each of the plurality of traction gates permits water flow through the tunnel from the bow end to the stern end when the ski moves forward while closing to prevent water flow when moving in the reverse direction, and wherein water cannot pass through the second opening and is contained within the tunnel when the traction gates are closed.

Another aspect of the invention provides a water walking apparatus, comprising: a pair of water walking skis, each water walking ski comprising: an elongated body having a bow end in the form of a monohull and a stern end in the form of a twin hull, the elongated body further including a top deck and a recessed area for foot placement within the top deck; two parallel side extensions which protrude downward from the top deck; a bottom cover located beneath the top deck and between the parallel side extensions, wherein the top deck, the side extensions, and the bottom cover together form a tunnel, the tunnel including a first opening near the bow end for admitting water and a second opening near the stern end for expelling water; and a plurality of traction gates mounted within the tunnel, wherein each of the plurality of traction gates permits water flow through the tunnel from the bow end to the stern end when the ski moves forward while closing to prevent water flow when moving in the reverse direction, and wherein water cannot pass through the second opening and is contained within the tunnel when the traction gates are closed.

Another aspect of the invention provides a method for boarding and/or reboarding a pair of water walking skis in deep water, the method comprising the steps of: providing a water walking apparatus, the water walking apparatus comprising a pair of water walking skis and a pair of ski poles, each water walking ski comprising: an elongated body having a bow end in the form of a monohull and a stern end in the form of a twin hull, the elongated body further including a top deck and a recessed area for foot placement within the top deck; two parallel side extensions which protrude downward from the top deck; a bottom cover located beneath the top deck and between the parallel side extensions, wherein the top deck, the side extensions, and the bottom cover together form a tunnel, the tunnel including a first opening near the bow end for admitting water and a second opening near the stern end for expelling water; and a plurality of traction gates mounted within the tunnel, wherein each of the plurality of traction gates permits water flow through the tunnel from the bow end to the stern end when the ski moves forward while closing to prevent water flow when moving in the reverse direction, and wherein water cannot pass through the second opening and is contained within the tunnel when the traction gates are closed, each ski pole comprising: a shaft including a grip and a pole strap located at the top of the shaft, the pole strap including a fastener; and a cylinder radially attached to the bottom of the shaft, the cylinder including a binding strap for binding the skis and poles together; gathering the skis and poles; binding the skis and poles into a raft-like unit with the binding straps; climbing aboard the raft; maneuvering to an upright position; unbinding skis and poles; stowing the binding straps; and using the water walking skis for efficient, self-propelled travel across the water by moving in a similar manner as cross-country snow skiing.

Another aspect of the invention provides a ski pole for balance when using a water walking ski, the ski pole comprising: a shaft including a grip and a pole strap located at the top of the shaft, the pole strap including a fastener; and a cylinder radially attached to the bottom of the shaft, wherein the cylinder includes: a pair of notches located opposite one another at the bottom of the cylinder; a plurality of air relief holes positioned equidistant from one other between the notches; a binding strap attached to the top of the cylinder for binding the skis and poles together; a pair of bevel recesses located opposite one another at the top of the cylinder, each bevel recess being vertically aligned with one of the pair of notches located at the bottom of the cylinder; and a lower chamber which provides an open ended compartment beneath the undersurface of the cylinder, wherein the shaft is connected to the cylinder without penetrating the lower chamber.

The nature and advantages of the present invention will be more fully appreciated after reviewing the accompanying drawings, detailed description, and claims.

BRIEF DESCRIPTION OF THE DRAWINGS

The accompanying drawings illustrate embodiments of the invention and, together with a general description of the invention given above, and the detailed description given below, serve to explain the principles of the invention.

FIG. 14 illustrates the front of a traction gate leading end with louvers closed:

FIG. 15 illustrates the back of a gate trailing end with louvers closed;

FIG. 16 is a left side view of a traction gate with louvers closed:

FIG. 17 is a right side view of a traction gate with louvers closed;

FIG. 18 illustrates a traction gate leading end with louvers open;

FIG. 19 illustrates a traction gate trailing end with louvers open;

FIG. 20 is a left side view of a traction gate with louvers open:

FIG. 21 is a right side view of a traction gate with louvers open;

FIG. 26 is a perspective view of a ski deck with binding strap attached:

FIG. 27 is a perspective view of a ski pole with a binding strap through notch;

FIG. 28 is a perspective view with the binding strap through both notches;

FIG. 30 illustrates step one in the deep-water-boarding process;

FIG. 31 illustrates step 2 in the deep-water-boarding process;

FIG. 32 illustrates step 3 in the deep-water boarding process;

FIG. 33 illustrates step 4 in the deep-water-boarding process;

FIG. 34 is a raft front view of step 4 in the deep-water-boarding process:

FIG. 35 is a raft rear view of step 4 in the deep-water-boarding process;

FIG. 36 is an inner side view of an embodiment of a left-footed water ski:

FIG. 37 is an inner side view of an embodiment of a right-footed water ski:

FIG. 42 is a close-up of a pole coupling according to the present invention;

FIG. 43 is a side view of the pole coupling of FIG. 42;

FIG. 52 show the arrangement of a second ski pole in the reboarding process:

FIG. 53 illustrates a typical hasp connector and cross-strap for use with the present invention:

FIG. 54 shows an assembled "raft" for the reboarding process:

FIG. 58 is a frontal view of a cape for use with the present invention;

FIG. 59 is a front view of the cape of FIG. 58 when deployed;

FIG. 60 is a rear view of the cape of FIG. 58 when deployed;

DETAILED DESCRIPTION OF THE INVENTION

The present invention provides both water walking equipment, and a method for water walking. The equipment typically includes a pair of buoyant skis, each in the form of a small watercraft, float, or hull which can be stood upon and maneuvered in the water. The user, secured and standing on the skis, is able to move along the surface of the water without a motorized device and without the need to be towed. The length of each ski greatly exceeds its width or height, and typically one ski is not attached to the other ski, which allows for an unencumbered walking movement during use.

The underside of each ski is shaped such that the leading section is functionally different from the trailing section, the bow or leading section being of a monohull design contoured for maneuverability and control, while the stern or trailing section is in the form of a twin hull, contoured for stability and power. Other preferred equipment for use with the inventive skis is described in detail below, and includes a novel pair of ski poles, which have two principal purposes for use with the present invention: (1) to augment user movement and balance when upright, and (2) as part of a "raft" which is created by the user during the boarding/reboarding process. Binding straps are disclosed which allow the user to reboard the skis in the event that they fall of the skis while in deep water, and an optional training collar is also disclosed herein, which can be used as to safely allow freedom of leg movement while preventing the skier's legs from spreading too far apart. Other inventive accessories for the inventive skis include a light-weight water repellant cape (referred to herein as SailWear), and a "seat" in the form of a buoyant waterproof plank which may be suspended across the decks of a pair of bound skis, providing the option to sit, rest, relax, and navigate on a raft.

Figure 1:
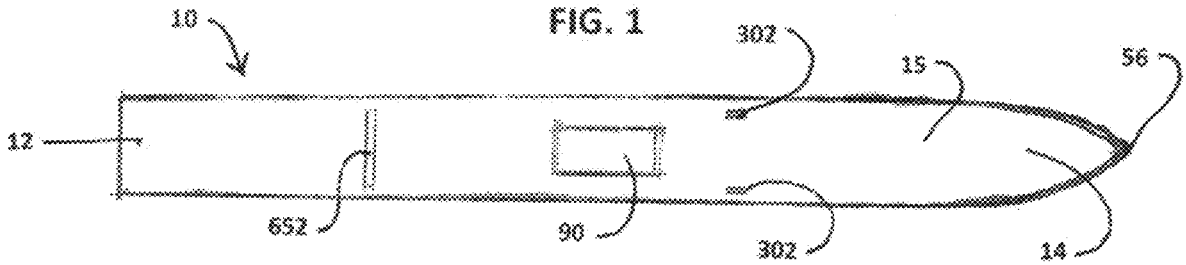
FIG. 1 is a top view of a water ski embodiment according to the invention.

A top view of one embodiment of a cross-country water ski according to the present invention is shown in FIG. 1. This view illustrates the general shape of the inventive ski according to the invention, the ski having an elongated body 10 with a monohull front or bow end 14 which is arcuate to its foremost tip, and a twin hull rear or stern end 12 which is more angular and in the form of a twin hull, like a catamaran. The top of the ski is referred to as a deck 15, the surface of which may be covered with a soft waterproof material, such as a foam pad to provide cushioning. The top deck 15 has a recessed area 90 for foot placement within. Looking at FIG. 3, it can be appreciated that the recessed area 90 is centrally located, preferably substantially in the center of the body 10 of the ski, whereby its location is critical with respect to balance when carrying the weight of the user.

Two parallel side extensions 42 protrude downward from the deck 15 at the stern end 12, so that the deck 15 also serves as a bridge (36, see, e.g., FIG. 7) between the side extensions 42. Fasteners 302 are illustrated in FIG. 1, affixed to the top surface of the ski. The fasteners can be hook-and-loop, snaps or any state-of-the-art quick fastening device able to be installed to the ski and ski strap. Each fastener 302 is positioned to receive a complementary fastener belonging to a pole strap, and is intended to be used during the process of boarding in deep water, as described in detail below. A plastic buckle with a flexible band 652 (typically 0.5-1.0 inches wide) can be secured to the deck 15 for the purpose of stowing a removable seat, also as described in detail below for FIGS. 30-33.

Figure 2:
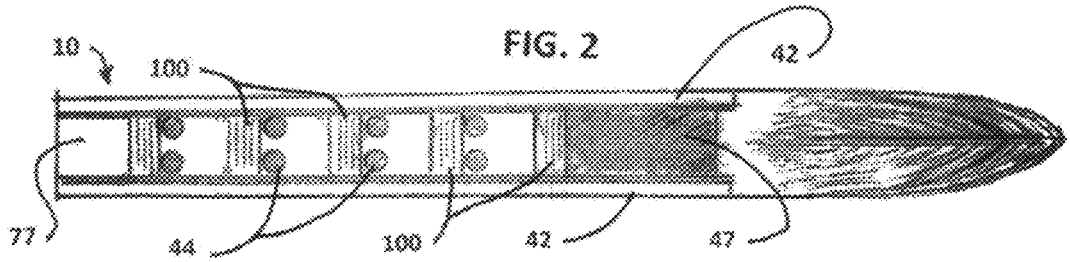
FIG. 2 is a bottom view of the water ski of FIG. 1.

FIG. 2 discloses a view of the bottom of the ski of FIG. 1. Two distinctly different hull profiles become apparent, with the bow, or the forward part of the body 10 being arcuate, with hydrodynamics which facilitate control over the forward direction of the ski. More specifically, the bow is in the shape of "V", similar to the hull of a monohull boat (see also FIG. 6). This shape is known for minimizing water resistance and drag. A single-V hull slices through water, is easily aimed, and is designed to plane, i.e. to move smoothly across the surface of the water. The stern, or the back part of the body 10, is in the shape of a twin hull catamaran, and includes a tunnel 75 with a plurality of traction gates 100.

Figure 3:
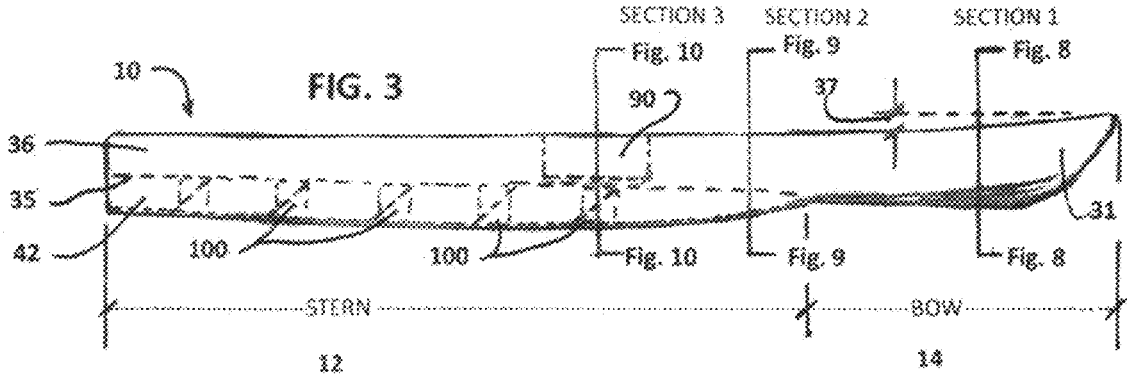
FIG. 3 is a side view of the water ski of FIG. 1.

Looking at FIG. 3, it can be appreciated that the bow 14 occupies approximately 30% of the total ski length, while the stern 12 occupies approximately 70% of the total ski length. On the deck surface, a sheer 37 eases the plane of the deck 15 upward and results in more freeboard 31, increasing the ski's hang by building volume. In boating terms, a vessel's freeboard is the distance from the waterline to the upper deck level, measured at the lowest point of sheer where water can enter the boat or ship. The intent is to allow the bow to skim on the water and not submerge while moving forward. Looking at FIG. 3 (and FIG. 1), a foot recess 90 can be seen located substantially in the center portion of the deck 15. A hash-mark delineation 35 indicates the location of the underside 38 of the bridge 36 in relation to the side extensions 42 (see also FIG. 7 illustrating the bridge 36 in relation to the side extensions 42).

Figure 7:
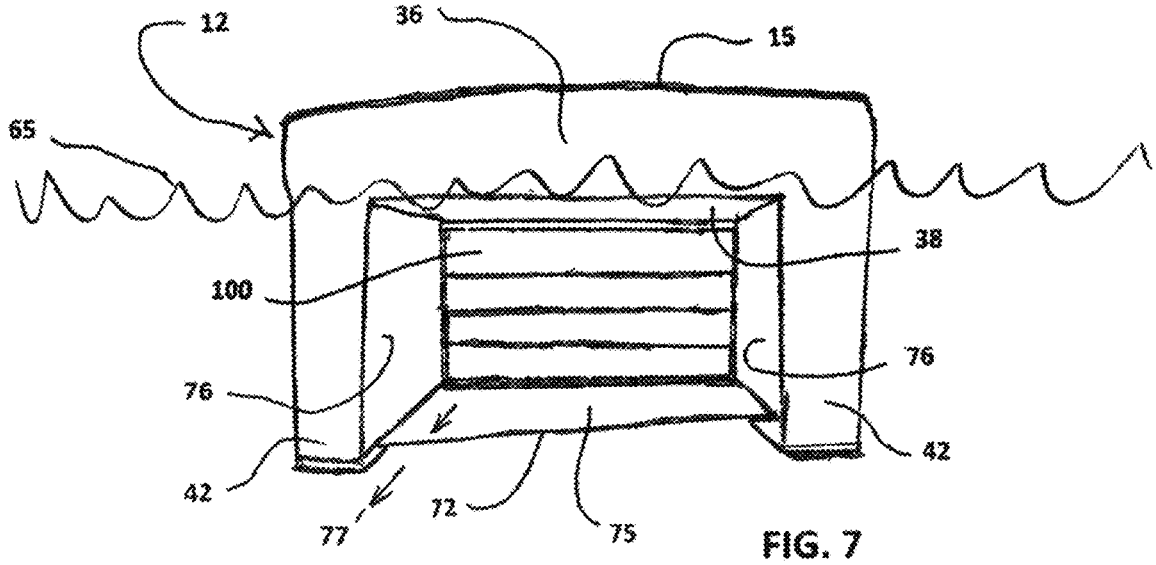
FIG. 7 illustrates the rear of the water ski of FIG. 1 from water level.

Looking at FIGS. 2, 3 and 7, it can be appreciated that the parallel side extensions 42, which protrude downward into the water from the deck 15, together resemble a catamaran-shaped twin hull having a bridge 36 portion suspended over the water (see e.g., FIG. 7). The bridge 36 spans the distance between the parallel side extensions 42. This twin hull design has very low drag, allowing the side extensions 42 to cut through the water, and will have lower resistance on the surface thus requiring less energy on the part of the user to move/cut through the friction. The side extensions 42 also widen the stance of buoyancy, i.e. provide buoyancy at the beam ends or sides of the deck, thereby making the ski more stable and minimizing side-to-side roll.

The side extensions 42 begin at about one quarter of the length of the ski from the bow, and extend to the tail end of the ski (see, e.g., FIG. 3), and thus also allow the stern 12 to track behind the bow 14 and minimize yawing (side to side movement of the bow and stern, similar to swiveling on a chair). As best seen in FIG. 7, the pair of parallel side extensions 42, the bridge 36 portion of the deck, and a planar bottom cover 72 together form a tunnel 75 which envelopes a plurality of traction gates 100. The underside or bottom cover 72 passes under the plurality of gates 100 and serves to structurally enclose the gates 100 within the tunnel, between the side extensions 42 and beneath the bridge 36. The bottom cover 72 also runs horizontally from bow to stern, substantially the length of the side extensions 42. The bottom cover 72, typically in the form of a planar layer of durable material, can preferably be installed across the underside of the plurality of traction gates 100, traversing between and secured to the insides of the downwardly projecting side extensions 42. The bottom cover 72 can be fabricated to be removable, and generally completes the tunnel 75 as a rectangular tube which enables water to flow freely therethrough when the gates 100 are open, and conversely to become entrapped and contained within the ski when the gates are closed.

Looking at FIG. 2, the leading end of the tunnel begins proximate the bow end 14 as a first opening 47 which allows water to flow under the deck 15 and through the plurality of gates 100. A large screen, as illustrated and labeled in FIGS. 11 and 12, preferably covers the first opening 47 to prevent unwanted debris such as seaweed or driftwood from entering the interior of the ski and impairing gate operation. A second, rear opening 77 of the tunnel is near the stern end, for expelling water.

Figure 11:
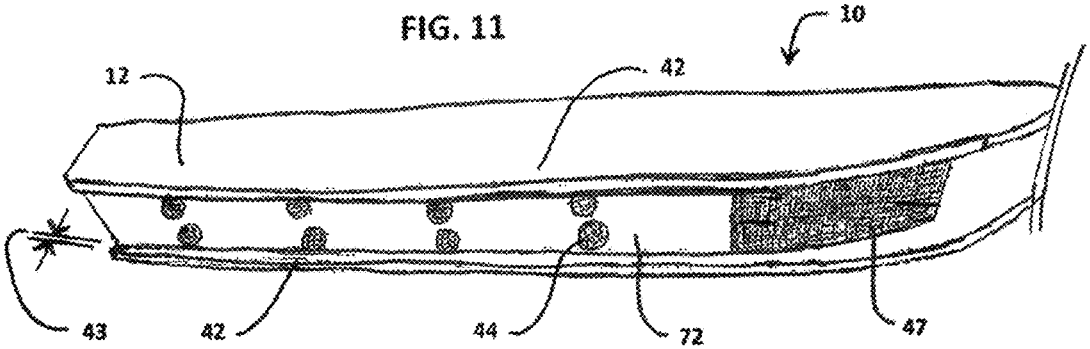
FIG. 11 is a perspective view of the hull stern "twin-catamaran" section.

The bottom cover 72 can also include screen covered round openings, referred to as gate vents 44, which are strategically positioned within the material of the planar bottom cover. The gate vents 44, as best seen in FIGS. 2 and 11, are small perforations within the bottom cover 72 that are positioned at the leading edges of each gate 100 to allow water to pass into and out of the gates, augmenting gate performance. Their primary function is to ensure that an adequate amount of water is present within each gate, allowing the tunnel to strain, entrap and contain "compartments" of water between a plurality of closed gates 100, while minimizing impediment of water flow during forward movement. The gate vents 44, like the first opening 47, are typically covered by or include screens, again to prevent unwanted debris from entering.

The plurality of traction gates 100 are best seen in FIG. 3, preferably spaced equidistantly from one another and mounted within the tunnel. The traction gates 100 preferably permit water flow therethrough from the bow end 14 to the stern end 12 when the ski moves forward, but the gates close to prevent water flow when the ski is moving in the reverse direction. The tunnel 75, in combination with the plurality of traction gates 100 spaced apart therein, also allows water to be contained within the ski when the traction gates are closed, thereby providing ballast. Specifically, the side view illustrated in FIG. 3 delineates the bow 14 and the stern 12, and shows five (5) separate traction gates 100, each one spaced equidistant from the next within the area enveloped by the side extensions 42, the bottom of the deck 36 and the cover 72 (see also FIG. 7). The resulting rectangular tube configuration, with a plurality of traction gates 100 spaced apart therein, allows "blocks" of water to be contained within the tunnel while the gates are closed, thereby providing ballast and improving stability by lowering the center of gravity of the ski.

Figure 4:
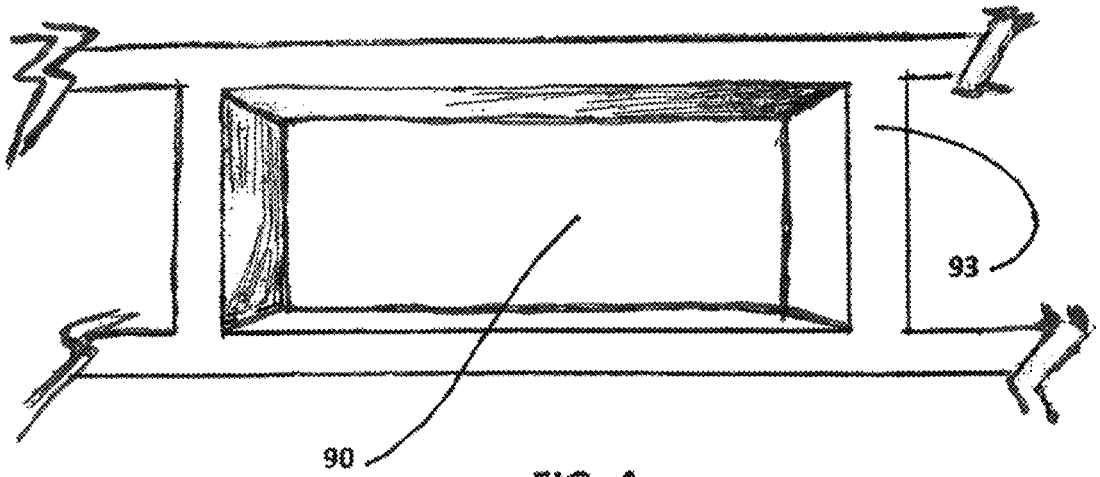
FIG. 4 is a perspective view from above the water ski of FIG. 1.

FIG. 4 shows the foot recess 90 within the body 10 of the ski for lowering the center of gravity as related to receiving the weight of the skier. The recess 90 is a cavity within the center of the ski deck which receives a foot binding 95, 97, illustrated in FIG. 5. The recess 90 is limited to providing only enough space necessary to receive a suitable binding. In one, non-limiting embodiment, the dimensions can be 12.5-inch length, 5.0-inch width and 4.0-inch depth. Another embodiment of the recessed area 90 may include a structural basket which is to be hung from the deck surface by support members 93. The basket can be constructed of material with strength to maintain its integrity under the load of the user's weight. The support members 93 can distribute weight load over an enlarged area of the body 10 of the ski. A different embodiment may include a planar support representing the bottom of the recess 90, whereby the planar support is secured to stringers 45, laden within the integrity of the buoyant substrate 39 (see FIGS. 8-10).

Figure 5:
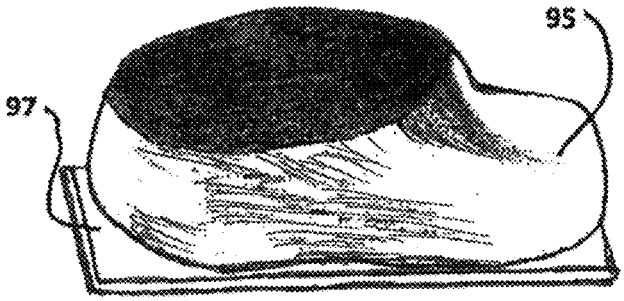
FIG. 5 illustrates a foot binding according to the present invention.

FIG. 5 illustrates one embodiment of a foot binding for the foot recess 90 which includes a waterproof shoe 95 secured to a waterproof binding platform 97. The binding platform 97 can be secured within the bottom of the recess 90 to provide a support surface to stand on, and to transfer the user's weight onto the ski. The outer measurements of the platform 97 can allow it to fit snugly within the recessed area 90. The binding shoe 95 is typically sized to fit the user's foot tight enough for ski control, but loose enough so that the user's feet will release themselves from the shoe in the event of a fall off the skis. In addition to the description above, readily adjustable bindings and other embodiments of waterproof foot bindings are well known in the art, and can be used with the present invention. Nonetheless, in case of a fall, it is intended that the foot will be able to easily slide out of the shoe 95, an important and necessary safety feature.

Figure 6:
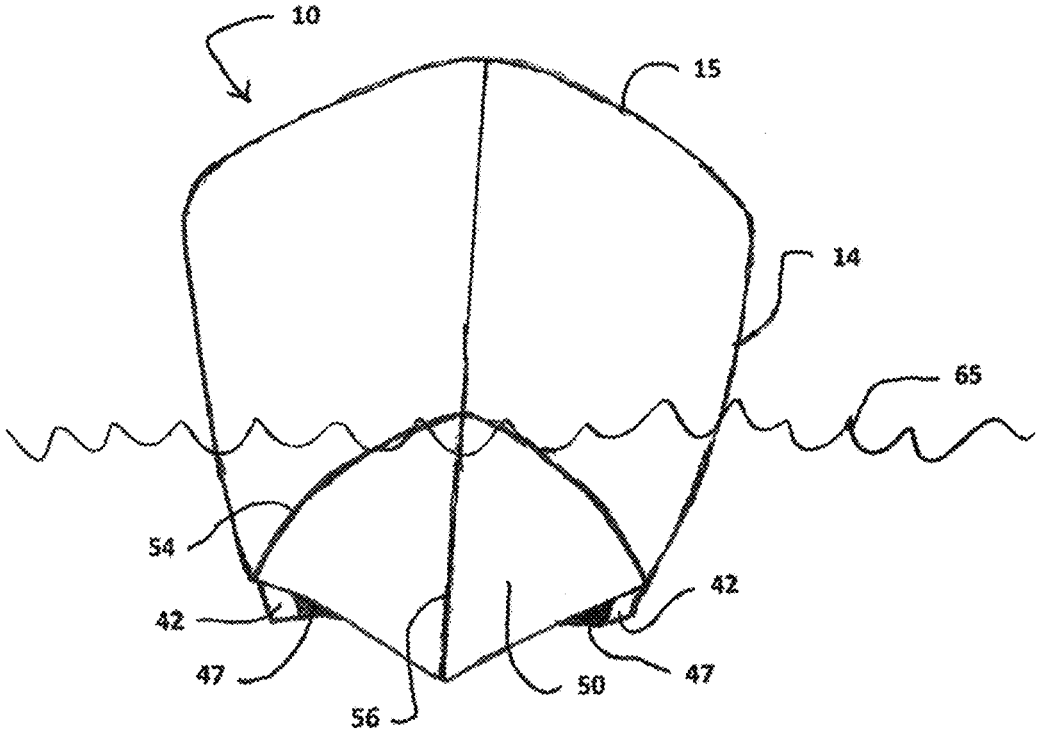
FIG. 6 illustrates the front of the water ski of FIG. 1 from water level.

FIG. 6 illustrates a perspective view of the bow 14 or front of the inventive ski, which, unlike the twin hull design of the stern 12, takes the form of a V-shaped monohull. This monohull design includes a center-ballasted keel 56 which minimizes yawing, and is much more maneuverable than if the bow had a twin hull. The illustrated embodiment facilitates directional control and allows the user to tack quickly. The leading ends of the side extensions 42 begin the transition from the monohull bow 14 to the twin hull stern 12, and the screened opening 47 can be partially seen between them. Also illustrated are an outline of the top of the ski or deck 15 and a chine 54, where the sides of the ski's hull meet at an angle with the underside of the hull 50. The water level 65 illustrated in FIG. 6 exists when the ski is under the full load of the user, whereby the user's weight is within the appropriate range for the ski size.

FIG. 7 illustrates a perspective view of the stern 12, also indicating the water level 65 when the ski is under the full load of the user. A tunnel area 75 is formed by the top of the deck 15, which also serves as a bridge 36 in this portion of the body 10, with the bridge 36 spanning the distance between the side extensions 42. The tunnel area 75 of the stern is bounded by the underside 38 of the bridge 36, the inner sides 76 of the side extensions 42, the rear gate 100, and the bottom cover 72. Water exiting the rear gate 100 passes through this tunnel area 75.

Figure 8:
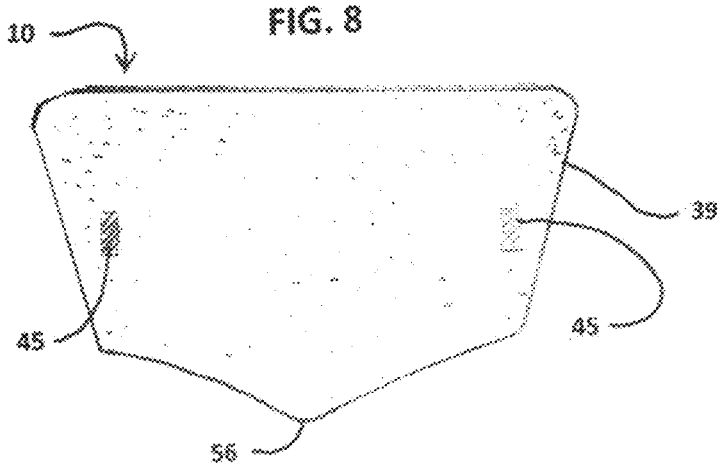
FIG. 8 is a cross-sectional view of a "V" monohull of the water ski of FIG. 1.
Figure 9:
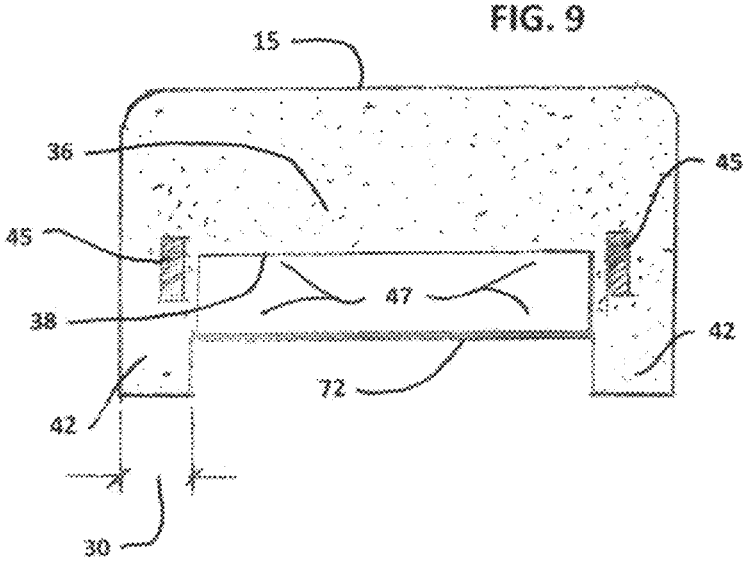
FIG. 9 is a cross-section of a tunnel opening in the water ski of FIG. 1.
Figure 10:
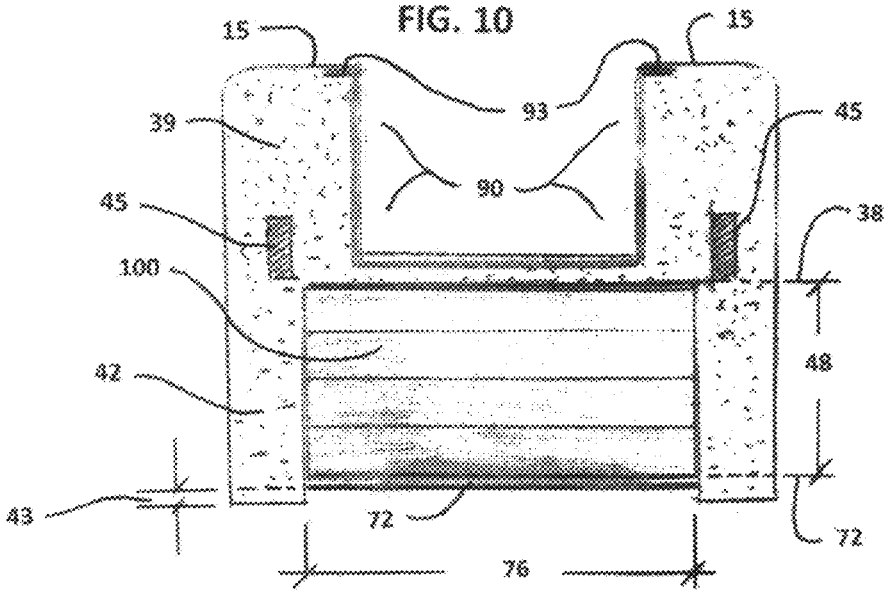
FIG. 10 is a cross-section of the hull of the water ski of FIG. 1.

FIGS. 8-10 are cross-sections of the ski body 10 illustrated in FIG. 3. Section 1 of FIG. 3 is shown in FIG. 8, outlining the shape of the bow as V-monohull style. The outer encasement material 39 may be fiberglass or a polycarbonate composite to protect the integrity of buoyant substrate within and to strengthen the ski. Stiffening stringers 45 can be positioned as needed for structural integrity, e.g., to prevent the ski from buckling or otherwise becoming disfigured.

Section 2 of FIG. 3 is shown in FIG. 9, which illustrates the body 10 transitioning between the bow and the stern, and from a monohull to a twin hull design. Looking at FIG. 9, it can be appreciated that the side extensions 42, which are not present in FIG. 8, are beginning to be developed under the bridge 36. The stiffening stringers 45 from FIG. 8 are again seen in FIG. 9, as they continue running longitudinally through both sides of the entire length of the body 10. FIG. 9 also shows the screened opening 47, which is the leading end of the tunnel 75 illustrated in FIG. 7. The bow end of the tunnel, i.e. the screened opening 47, is framed between both side extensions 42, the bottom 38 of the bridge 36, and the bottom cover 72.

Section 3 of FIG. 3, shown in FIG. 10, is substantially through the foot recess 90 of the body 10. Here, the side extensions 42 are fully developed, and this portion of the deck 15 includes the foot recess 90. Also shown is a structural reinforcement 93 of the foot recess. The recess 90 can be lined with structural members which are hung from the deck of the ski. In another embodiment, the foot recess binding platform 97 (see FIG. 5) may be suspended between and supported by the stiffening stringers 45.

One of the plurality of gates 100 is also illustrated in FIG. 10, whereby the width of its frame conforms to the width 76 of the tunnel 75. The depth 48 of the tunnel, through which water passes when the gate 100 is open, is the distance between the bottom of the bridge 38 and the top of the bottom cover 72. Looking at FIG. 10, it can be appreciated that the side extensions 42 extend lower than the bottom cover plate 72. This distance 43 can be between about one-half inch and one and a half inches, and in one embodiment the distance is preferably about 0.8125 inches; however, this distance 43 may vary depending upon the thickness of cover plate material, the height of the side extensions, and the size of the gate frame. This difference in elevation 43 between the cover 72 and bottom of the side extensions 42 provides protection when on rocks or solid land.

Looking again at FIG. 9, the thickness 30 of the side extensions 42 is illustrated, which can vary according to the size of ski/hull; however, the thickness 30 will be in a range of about 0.5 inches to about 3.0 inches, and more preferably between about 1.0 inches and 2.0 inches. Looking at FIG. 10, the bottom cover 72 is illustrated having a thickness of between about 0.1 inches to about 0.2 inches thick, and preferably about 0.1875 inches thick, and can be fabricated to be removable from the ski.

FIG. 11 is a perspective view of the underside of the hull of the inventive ski illustrating right side and bottom of stern 12, in which it can be appreciated that the bottom of the side extensions 42 and the cover 72 differ in elevation 43. This difference allows the ski to rest on its side extensions when on solid land, and protects the gates 100 from compression. The bottom cover 72, which is typically able to withstand the weight of ski and skier, includes the screen-covered gate vents 44 and can also include the screen for the screened opening 47. The gate vents 44 allow particulate debris such as beach sand to wash out of the tunnel 75 by water flow as the ski advances. The screens for the gate vents 44 and the screened opening 47 can also prevent larger floating debris, such as seaweed or driftwood, from entering the tunnel.

Figure 12:
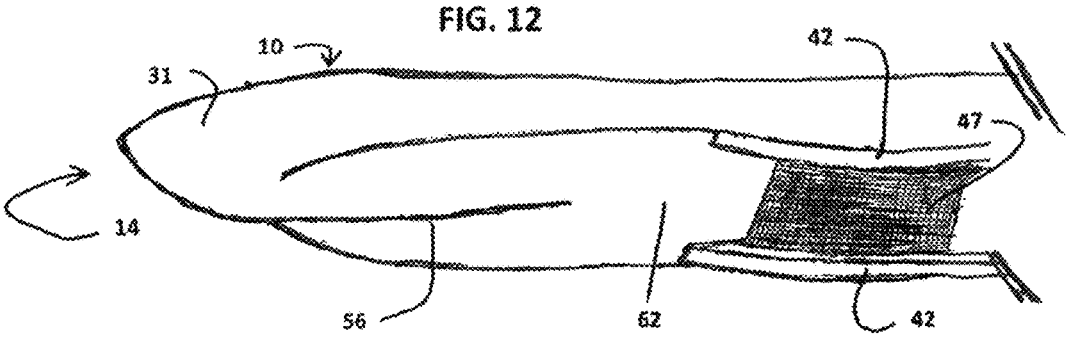
FIG. 12 illustrates how the hull shape transitions.
Figure 13:
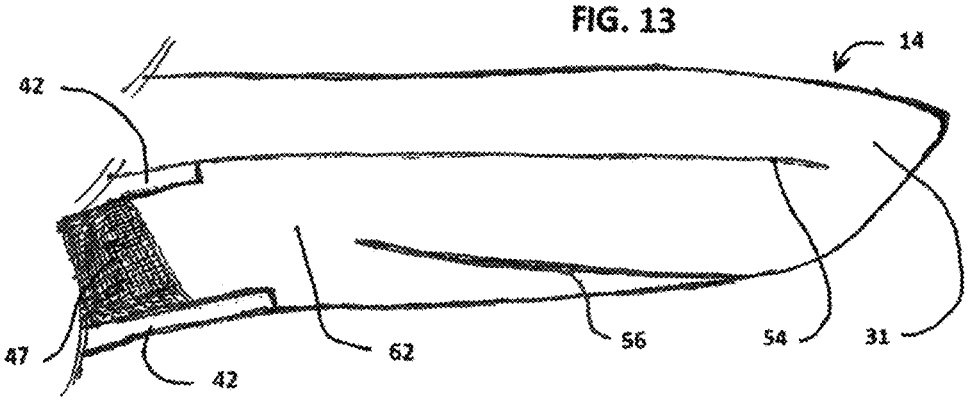
FIG. 13 is a perspective view featuring a bow "V-monohull" style hull.

FIG. 12 is a perspective view of the underside of the body 10, illustrating the transition from a monohull bow 14 to a catamaran-type stern 12. The transitional area becomes planar 62 under the ski, between the trailing end of the keel 56 and the leading end of the side extensions 42. FIG. 13 illustrates the right side and bottom of the bow 14, in which the angle of the keel expands the ski's freeboard 31 above the chine 54 as the keel 56 rises to meet the fore tip of the ski. The keel profile allows the bow 14 to skim over the surface of the water and not submerge while moving forward, as a result of lift produced hydrodynamically.

FIGS. 14-21 illustrate in more detail a preferred embodiment of a traction gate 100, in accordance with the present invention. As noted above, a plurality of traction gates 100 are preferably employed as a propulsion means, each spaced equidistant from the next and contained within the tunnel 75, which is bounded by the side extensions 42, the bridge 36, and the bottom cover 72 (see, e.g., FIG. 7). Looking at FIGS. 14, 15, 18 and 19, it can be appreciated that each traction gate 100 is generally an enclosed structure comprised of diagonally oriented, hinged flaps or louvers 114 secured within a rectangular frame 112. When used in series as illustrated and described herein, the plurality of traction gates 100 can "grip" the water and enable forward movement. A predetermined number of traction gates can be placed within each pair of skis, depending on the size of the ski as well as the size and weight of the skier.

The use of hinged louvers is advantageous because they can produce minimal drag when the ski moves forward. Prior art fixed structures with directional bias produce more water resistance when gliding forward as compared to the hinged louvers. The louvers described herein open the traction gates during forward movement and thus decrease resistance. The traction gates also minimize backslide. "Backslide" is the action of a skier's foot sliding backwards as forward pressure is applied by each stride. It represents movement inefficiency, and is a waste of skier energy. During the motion of walking, there is typically no backslide because each foot is firmly and frictionally grounded as the opposite foot is advancing in stride. Conversely, a ski is slippery on water and will have the tendency to slip and slide with the slightest pressure against it. One objective of this invention is to resemble the motion of walking. It would be advantageous, therefore, to minimize, if not eliminate, backslide. Compared to prior art fixed structures, baffles, or large monolithic paddles, rotation of the individual louvers in each of the plurality of traction gates can stop water flow faster. Having a plurality of the gates 110 within the tunnel 75 also minimizes backslide through the aggregate entrapment of water within the tunnel. That is, water becomes contained within the tunnel when the traction gates 100 are closed, providing ballast and a lower center of gravity within the water. In addition, the diagonally oriented hinge axles 132 reduce the travel distance of the leading edge of the louver.

There are a variety of means by which the diagonally oriented, hinged louvers 114 can be secured within the frame 112. A preferred embodiment, illustrated in FIGS. 16-21, is by way of an axle 132 rotatably connected to each louver 114. In one embodiment the axle may be monolithically constructed with the louver; nevertheless, the axle 132 is generally adjoined to or otherwise passes through a longitudinal edge of the louver and extends beyond both side ends of louver into the frame 112. The frame 112 may be fabricated as a component which is attached within the tunnel 75. As a non-limiting example, the frame 112 may be fabricated within the ski hull. The material making up the axles 132, louvers 114 and frame 112 can be a non-ferrous metal, a polycarbonate composite, or a combination of materials known in the art.

The plurality of louvers 114 within each frame 112 are preferably arranged whereby the pivot points of all axles 132 are linearly aligned in a diagonal manner within their respective side of the frame. Looking at FIG. 16, one embodiment of a diagonally oriented line 117 of pivot points for the axles 132 is illustrated, having an angle that is offset from vertical. As a non-limiting example, this angle can be offset from a vertical orientation (i.e. 90 degrees) between about 10 degrees to about 70 degrees, more preferably between about 30 degrees and about 60 degrees, and most preferably about 50 degrees from vertical. The louvers 114 close against one another and against the walls 134 of the frame 112. The free longitudinal edge 136 of each louver, opposite its hinged longitudinal edge 132, is positioned within the frame so that there is an area of overlap 145 with the edge of its adjacent louver, such that the leading edge 136 of any louver closes underneath and against the trailing edge of the louver above it. FIGS. 15-17 illustrate how each louver 114 opens in an upward direction, and FIG. 15 also shows stops 119 which can be installed on the inside of each frame 112 to prohibit each louver 114 from opening beyond horizontal.

The relatively small size of each louver, as compared to prior art, full sized paddles, reduces the arc or "distance" which the outer edge of the louver/paddle must sweep from an open to a closed position. As a result, each louver closes more quickly than a full sized paddle, traction is developed more quickly, and backslide is minimized. Backslide is also reduced by the traction gates 100 because of the reduced angle of rotation of the individual flippers or louvers 114. The reduction of the angle of rotation which is provided by the offset angle of the diagonally oriented line 117 (e.g., of about 50 degrees from vertical) reduces the arc distance needed to open and close the gates, such that each louver closes more quickly than if they were in a ninety degree, vertical orientation. For example, a comparison between the plurality of louvers 114 present in each gate 110 and one larger paddle of equal total size shows the following: 4.0× 1.25-inch louvers=5.0 inches, less three overlaps (3.0× 0.125=0.375-inch overlap)=4.625-inch paddle. 1.25-inch radius @ 50-degree angle of rotation=1.09-inch arc. 4.625-inch radius @ 50-degree angle of rotation=4.036-inch arc. The edge of one 4.625-inch paddle travels 3.7 times the distance of the edge of one 1.25-inch louver, given the same angle of rotation. Therefore, multiple smaller paddles close significantly faster than one large paddle of equal total size. Less distance means faster closure of gate and therefore less backslide.

"Blow-by" is a term used for water escaping from the force of a paddle by taking its path of least resistance around the outer edges of the paddle, rather than being moved by the paddle. Blow-by is a loss of water resistance, which is inefficient for water walking purposes. The present invention minimizes blow-by because each traction gate is housed within a framework containing a plurality of hinged louvers operating in unison to open and close the gate. The plurality of gates will operate in concert, opening and closing simultaneously with the others. When the ski glides forward, the louvers open such that the plane of each louver is approximately horizontal. See, e.g., FIGS. 18-20. As the ski advances during each stride, water flow pushes each louver to open and become horizontally disposed. As forward movement slows, gravity causes each louver to drop radially around its hinge axel. As the ski moves backward, the louvers 114 transform into a solid plane within the frame 112. The plurality of louvers 114 within each traction gate 110 are arranged in a diagonal array of hinged pivot points within each frame 112. See, e.g., FIGS. 14-17.

Closure of the traction gate is the result of the plane created by the closed louvers spanning the inside of the frame. Such closure stops the flow of water both through and around the louvers, thus preventing blow-by and backslide. Therefore, when gates are collectively in "closed" status, water becomes entrapped between the gates 100 within the tunnel 75. In addition to adding ballast, the aggregation of contained water creates a substantive mass within the ski which produces a formidable static force counter acting the pressure of backslide.

The sweep of an individual louver's trailing edge 136 is illustrated in FIGS. 20 and 21. Sweep distance (arc)=radius (r) times theta (Θ). Therefore, if louver has a width of 1.25-inch and theta=0.87266 with 50-degree angle of rotation, the arc or "sweep distance" of the trailing edge of the louver is 1.09-inch. Assuming same louver size (1.25-inch), the arc calculated for 90-degree angle of rotation=1.96-inches, which is 79% more distance than 50-degree angle of rotation. The time it takes to travel that additional distance translates into a significant amount of additional backslide.

The inventive ski can be constructed within a range of dimensions, the length can typically be between 7.0 feet and 12.0 feet, and the width can typically be between 7.0 inches and 12.0 inches. The width must provide sufficient space to enclose functional traction devices, as described herein. A wider ski offers greater stability, but is less maneuverable. The typical height of the ski can range between 4.0 inches and 14.0 inches (variable due to transitioning shape of hull). A larger ski is better suited for a larger user, and will offer greater buoyancy and therefore support the weight of a heavier skier. However, the larger the ski, the more cumbersome and more difficult it is to control, and also the more difficult it will be to lift and carry out of the water. The gross weight limit of both user and ski equipment is estimated to be around 350 lbs. Optimal combinations with respect to the sensitive balance between buoyancy and maneuverability are the objective of each embodiment. One such embodiment, as a non-limiting example, can accommodate a skier weighing approximately 170-210 lb., with each of the skis being about 9.5 feet in length, 10.0 inches in width and 10.0 inches in height. Buoyancy may be achieved by state-of-the art means, such as the encasing High Density Polyethylene (HDPE) or expanded polystyrene (EPS) with polycarbonate material or fiberglass. As a non-limiting example, the ski can be essentially hollow with a relatively thin wall structure and filled with a lightweight, water resistant material such as an expanded polystyrene foam or a polyurethane foam. The wall structure can be molded from a tough, impact resistant material, such as polyethylene plastic, by a rotational molding process, as is known in the art. While some prior art skis are vulnerable to deflation, the inventive skis can be built to be durable and to remain buoyant if punctured.

A general design for a ski pole 200 for use with the present invention is shown in FIGS. 22-25. The ski pole is preferably used as a pair, primarily for assisting the skier in maintaining balance and advancing forward. There is also a fitness benefit from upper-body movement through repetitive use of the poles while skiing. Attached to the bottom of each pole 200 includes a cylinder 201 which produces buoyancy, and beneath the cylinder 201 is an open ended lower chamber 244 with air relief holes 214. The pole cylinder may be sized to suit the skier. For example, a cylindrical area containing expanded polystyrene and having a diameter of about 10.0 inches and a length of about 8.0 inches can produce about 16 lbs. of buoyancy. The pole cylinder 201 as shown includes a plurality of air relief holes 214, which are perforations in its side of typically about 0.75-inches in diameter. Each of the plurality of air relief holes 214 can be positioned equidistant from the other, so that as a group they circumscribe the cylinder 201. The ring of air relief holes 214 is interrupted by notches 212 on opposite sides, whereby the notches take the place of the holes. There is a concentric raised ring 210 circumscribing the perimeter around the top of the buoyant or upper section of cylinder. The raised ring includes a pair of opposing beveled recesses 225 whereby each recess 225 is vertically aligned with one of the notches 212 in the open ended or lower section of cylinder. A binding strap cover 211 can be located within the inner perimeter of the raised ring 210, and is intended to contain or otherwise cover the binding strap 242 (see, e.g., FIGS. 26-29) when the binding strap is not in use during the deep-water boarding process. The beveled recesses 225 are intended to guide the binding straps during the deep-water boarding process.

Figure 22:
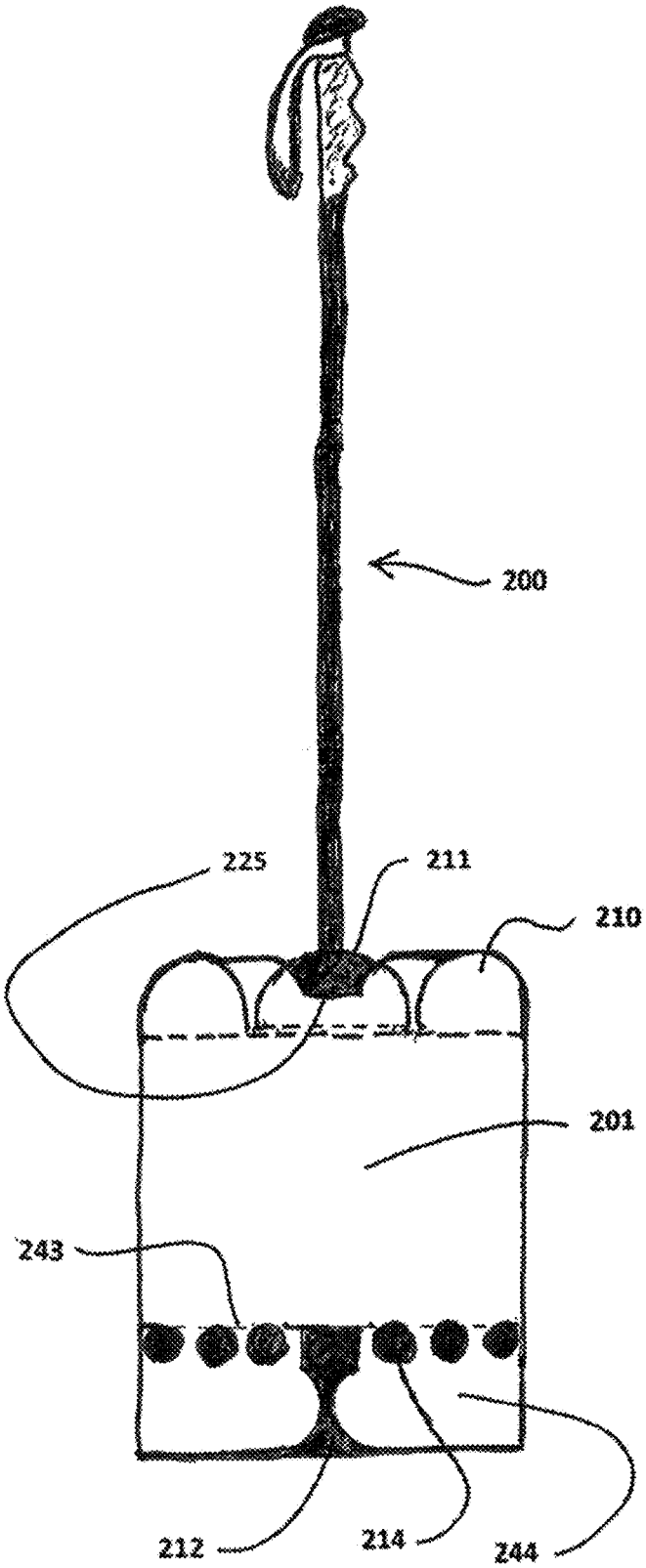
FIG. 22 is a side view of a ski pole according to the present invention.
Figure 23:
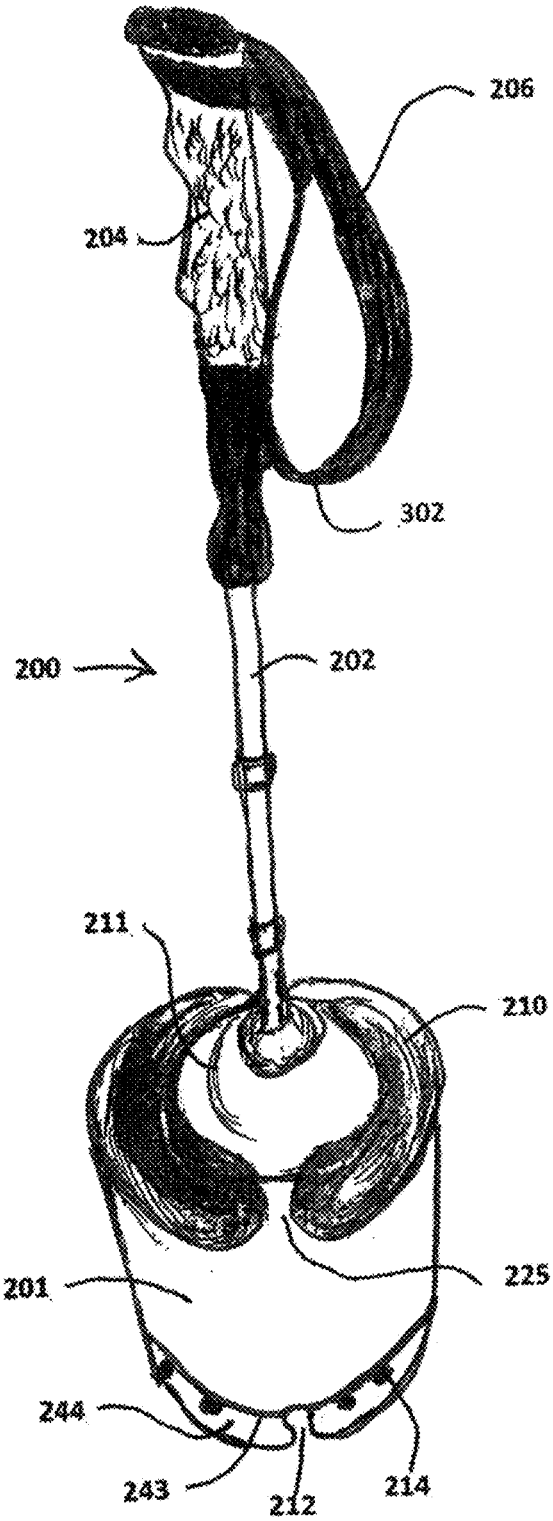
FIG. 23 is a perspective view of the top and side of the ski pole of FIG. 22.

FIG. 23 is a more detailed view of the pole embodiment 200 illustrated in FIG. 22. As shown, cylinder 201 is radially disposed around a shaft 202 which is fitted at the top with grip 204 and a pole strap 206. At the end of the pole strap a fastener 302 is shown, which can be a snap or a hook-and-loop type fastener. The fastener 302 is further shown and described in more detail below, pertaining to FIG. 30, and is related to the deep water boarding and reboarding process. The grip 204 can be ergonomically fashioned out of cork or rubber and secured to the end of the shaft 202. The shaft 202 can be made to be adjustable in length, whereby telescopic sections can be interconnected with suitable fittings as is known in the art. The circular bottom of the binding strap cover 211 fits within the inner diameter of the concentric, raised ring 210, and can be sized to house a binding strap 242 which can be spooled around the shaft 202. The cover 211 is radially disposed around the shaft 202 and can be fabricated to be readily raised and lowered along the shaft by the user. The binding strap 242 is further described herein and illustrated in FIG. 32, and is an integral component of the deep-water boarding process. The notch 212 and the beveled recess or strap guide 225 are also primarily used in the deep-water boarding process.

Figure 24:
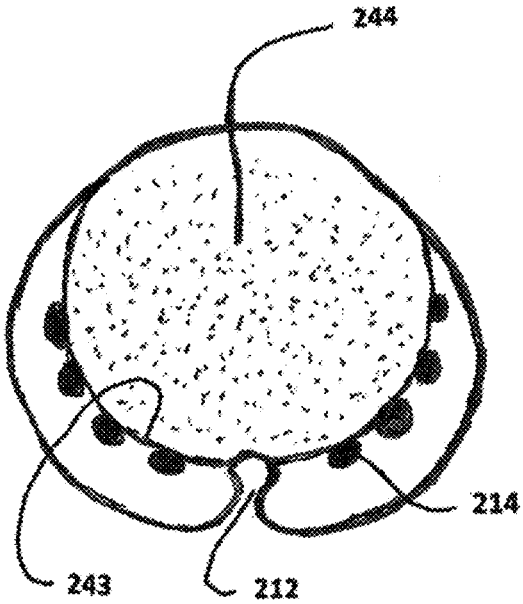
FIG. 24 is a perspective view of the bottom and side of the ski pole of FIG. 22.

FIGS. 22-24 show a delineation 243 circumscribing the cylinder 201. The delineation 243 marks the transition from the cylinder 201 to a lower chamber 244, which provides an open ended compartment beneath the undersurface of the cylinder 201. The walls of the lower chamber 244 are contiguous with the cylinder 201 and can include air relief holes 214. The cylinder 201 can be manufactured to be more buoyant than the lower chamber 244, for example, via hermetical containment, or by encasement with a buoyant material such as EPS (expanded polystyrene). The shaft 202 can be connected to the cylinder 201 without penetrating the lower chamber 244. The circumscribing air relief holes 214 of the lower chamber can readily allow air and water to exchange within the lower chamber 244 and beneath the undersurface of the cylinder 201 during use. This aeration within the lower chamber 244 creates surface agitation and reduces the surface tension of the water, facilitating penetration of the distal end of the cylinder into the water. This penetration allows the ski pole to hold its position and prevent it from "skating" across the water surface, providing the user with a moment of balance and control. This is similar to how a pointed tip on the end of a snow ski pole prevents the pole from slipping across the frozen surface, providing balance and control.

The air relief holes 214 can quickly drain as the pole is extracted from the water, preventing water from being held underneath the cylinder, and making it easier for the user to operate them, without wasted energy. Without the holes, the lower chamber 244 would tend to suck water up into itself as the pole is withdrawn from water, because water would be cohesively pulled up and held in the hollow chamber. This would result in additional pole weight, thereby requiring more effort by the skier. The overall cylindrical shape of the ski pole facilitates its use without regard for orientation: there is no front or back, so the user does not have to be concerned with gripping the pole to orient it in a specific direction. Such easy orientation in combination with the containment and release of water from the undersurface of the inventive ski pole, minimizes skating and provides a very efficient control and power component for the user of the inventive skis.

Figure 25:
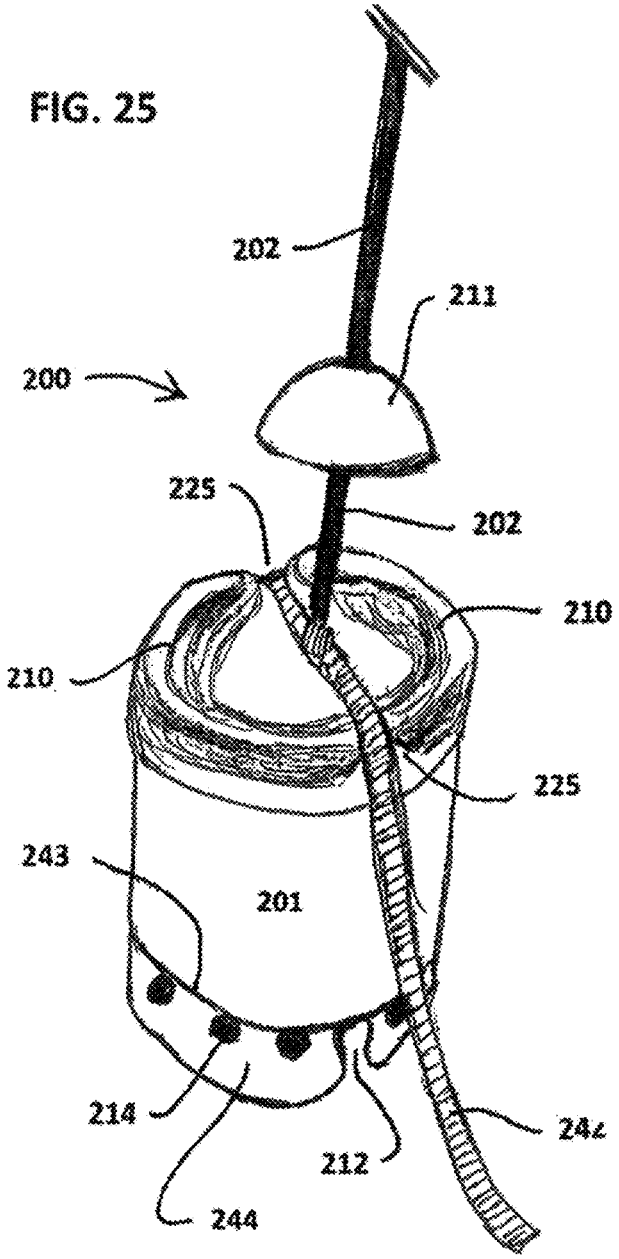
FIG. 25 shows a perspective view of the cylinder and the ski pole.

FIG. 25 illustrates the cylinder 201 and the shaft 202 of the inventive ski pole. The binding strap 242 is shown secured around the shaft 202, and draped over the beveled recess 225. The shaft 202 is confined by the binding strap; however, the strap is not adhered to shaft, yet rather is situated around the shaft and sewn together. Looking at FIG. 33, it can be appreciated that each of the binding straps 242 are intended to be wrapped around both skis and one of the two poles, then connected to itself on each end and pulled taut. Each of the beveled recesses 225 of the raised ring 210 is vertically positioned above both the respective notches 212 of its corresponding large cylinder 201. The beveled recess 225 are guides which aid in the alignment of the notches 212 under the pole, ensuring reception of the binding strap by the notches during the deep-water boarding process. A binding strap cover 211 is also shown in FIG. 25. FIG. 26 illustrates the binding strap 242 as it appears deployed around a ski edge 252, taut and secured through its rust-proof metal clasp 248. The ski edge 252, for example of ski 322, can also be seen in FIG. 33.

Figure 29:
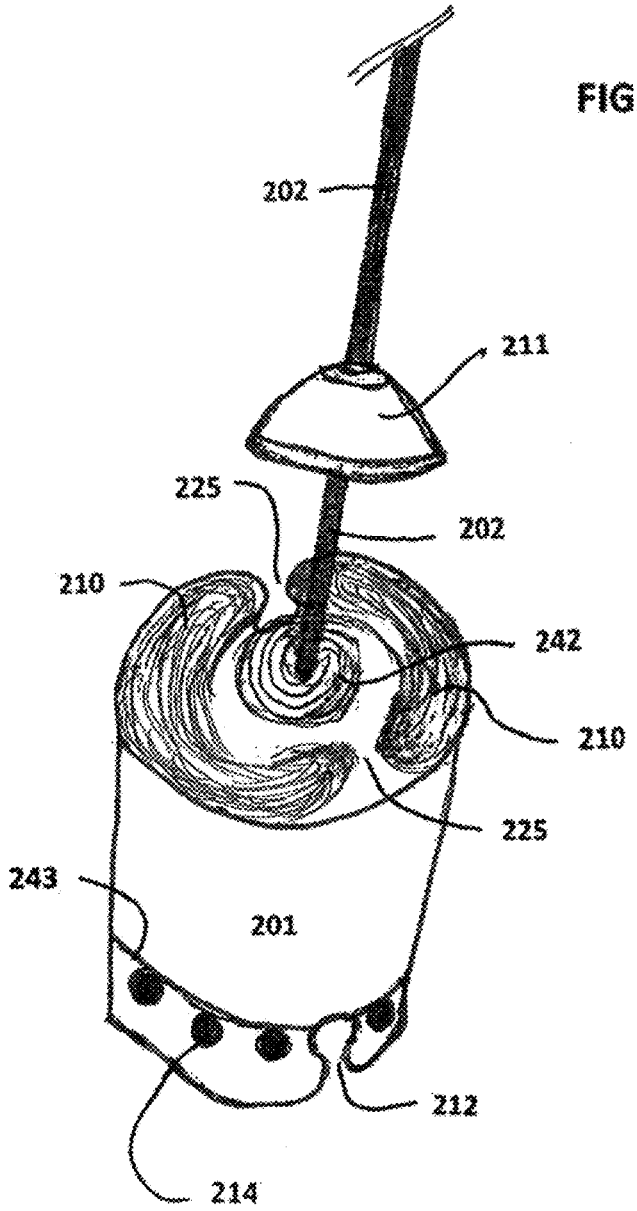
FIG. 29 is a perspective view of a spooled binding strap and housing cover.

FIG. 27 shows the binding strap 242 after being pulled through the notch 212 of the cylinder 201. As a non-limiting example, the notch 212 can be rectangular in shape and have a width (W) of between about 0.5 inches and 2.0 inches, more preferably about 1.0 inches, and it can be between 0.5 inches and 1.5 inches in height (H), and more preferably about 0.75 inches in height. The notch 212 can be a radially arcuate continuation of the of the lower chamber 244 of the cylinder 201. The top of the rectangular notch 212 can be coexistent with the delineation 243 between of the lower chamber 244 and upper portion of the cylinder 201. FIG. 28 shows the air relief holes 214 and the binding strap 242 as seen from the underside of the lower chamber 244. The binding strap 242 is illustrated strewn taut through both notches 212, and is suspended between the notches, flush to the underside of the lower chamber 244. FIG. 29 is a perspective view of binding strap 242 in stowage on the raised ring 210. The binding strap 242 is shown spooled around the shaft 202, for stowage beneath the raised binding strap cover 211. One beveled recess 225 of the concentric, raised ring 210 can also be seen in FIG. 29, positioned vertically above its respective notch 212 in its corresponding large cylinder 201.

The ability to board the skis in deep water is very important, and is sparsely addressed by the prior art. If the skier is unable to board the skis, either at the onset or after falling off the skis, the equipment becomes practically useless. For purposes herein, "deep water" means any depth of water in which the skier cannot touch bottom, and is therefore treading water. The skier will prefer to launch (start) from land or from a boat dock, to avoid boarding in deep water; however, the possibility of falling off the skis must be considered, and the user must be prepared to re-board under those circumstances. After falling off the skis, the skier will have four loose pieces of equipment floating around.

In one embodiment of the reboarding process, the first step in the deep water boarding process is to attach one pole to one of the skis, with the pole cylinder positioned to the rear of the ski. See FIG. 30. By attaching one pole to one ski, the skier now only has three items to handle, rather than four. More specifically, and looking at FIG. 30, one ski 312, i.e. a ski that is substantially similar to the embodiment 10 illustrated in FIGS. 1-10, and one ski pole, i.e. a ski pole 314 that is substantially similar to the embodiment 200 illustrated in FIGS. 22-29, are temporarily attached together with fasteners 302. As illustrated in FIG. 1 and described above, fasteners 302 such as snaps or hook-and-loop are affixed to the top surface of the ski, and each fastener 302 is positioned to receive a complementary fastener belonging to a pole strap 206 (see, e.g., FIG. 23).

FIG. 31 shows step 2 in the process of boarding in deep water. The second ski 322 is positioned on the opposite side of the attached pole 314, with both skis 312, 322 oriented in the same direction. An elastic band 379 can be used to combine the skis in an effort to quickly gather and keep the equipment together during the initial raft-building process. This elastic band 379 can be between about 12 inches and 18 inches in length, and typically about 15 inches, and can stretch to securely accommodate placement of the front pole 314 between the skis 312, 322. The band 379, also seen in FIGS. 32, 33 and 35, can be removed and stowed upon completion of the "raft" as described herein, and it can be stowed and/or connected to any of the fastener points 302 present on either ski deck.

FIG. 32 illustrates step 3 of the boarding process, showing all four pieces of equipment; the first pole 314 is still attached to the first ski 312 and is floating between the skis 312, 322. The second pole 332 is positioned between the skis in an area on the skis designated for binding the skis together. A binding strap 242 is stowed on each pole as described above (see, e.g., FIGS. 25-29), and at this time is removed from under its cover 211 by raising the cover and pulling on the ends of the strap. The strap can be secured around the pole shaft with one end being significantly longer than the other. The shorter end can typically include a metal clasp on its end. The longer end is to be wrapped around the two skis with the second pole 332 positioned between the skis and in the upright position. The distal end of the pole cylinder will extend downward to beneath the bottoms of the skis, and will be low enough to receive the binding strap through its notches (212, see FIGS. 22-29). By positioning the binding strap 242 through the beveled recess 225 as shown in FIGS. 27 and 28, the ski pole should rotate itself, causing the binding strap 242 to be suspended tightly between the notches 212, flush to the underside of the lower chamber 244. The long end of the strap 242 is inserted through the metal clasp on the short end and is pulled taut through the clasp, so that the two skis and the upright pole will now be bound together.

FIG. 33 shows step 4 of the boarding/re-boarding process, whereby the skis 312, 322 and the ski poles 332, 314 are bound by two binding straps 334, 344. Each binding strap 334, 344 is intended to be substantially similar to the binding strap 242 illustrated in FIGS. 25-29, and bound by a rust-proof metallic strap 248, as shown in more detail in FIG. 26. Step 4 is accomplished by removing the floating pole 314 from its temporary point of attachment with one of the ski's fasteners 302 (see FIGS. 30-32) and positioning it upright between the skis, in an area posterior to the foot recesses 90. Even though the fronts of the skis are already bound tightly together with the second ski pole 332 (see FIG. 32), there will be sufficient space between the skis in the rear for easily inserting the floating pole 314, because that pole had previously spaced the skis apart. The initial, floating pole 314 is then secured by the user between the rear of the skis, by its strap 344, in a manner similar to the front pole 332 binding process described in step 3, above. Specifically, the binding strap 344 is placed through the beveled recess of the floating ski pole 314, which will cause the pole to rotate itself upright and the binding strap 344 to be suspended tightly between the notches and flush to the underside of the lower chamber of the cylinder of the pole. The long end of the strap 334 is inserted through the metal clasp 248 on the short end, and is pulled taut through the clasp 248, so that the two skis and both of the poles (now upright) will now be bound together. The bound equipment results in a small "raft" having two ski poles between two skis.

FIG. 34 shows the front of the assembled "raft" of FIG. 33, as viewed from water level. It illustrates the front pole 332 situated between the skis 312, 322 whereby the bottom of the poles are at a level lower than the bottom of the skis. This difference in elevation 357 between the poles and the skis is the length of distal end of the pole, whereby the straps 334, 344 pass through both notches on their respective ski poles. The notches maintain the strap in position, and allow it to hold the bottom of the pole so that is assumes the upright position. FIG. 35 is a rear view of the assembled "raft" of FIG. 33, showing the rear pole 314 between the two skis 312, 322 and two binding straps 334 344, and the difference in elevation 357 between bottom of the rear pole 314 and bottoms of skis.

Step 5 of the boarding/re-boarding process involves the user boarding the raft facing forward. This can be accomplished because the raft represents a relatively stable craft, the deck of which is only a few inches above the water. It is, otherwise, nearly impossible to board each ski separately if not bound together. Step 6 of the boarding/re-boarding process involves a transition of the skier's position from a "hands and knees" position to an upright position. Poles may be used to facilitate balance, as the feet are inserted into the recessed areas 90 of each ski. Step 7 of the boarding/re-boarding process involves disconnecting the rear pole 314 by depressing the clasp 248 on its strap 334, thereby releasing and disconnecting the ends of the strap. The user then grabs the rear pole 314 and lifts the pole up so that the strap will remove itself through the notches on the underside of the pole cylinder. At this point, the skis and front pole are still secured together, and the raft will remain relatively stable. The user then can spool the rear strap around its pole shaft and stow the strap under the cover, as described in detail above. Step 8 of the boarding/re-boarding process involves disconnecting the front pole 332 by grabbing the pole with one hand and depressing the clasp on the front binding strap with the other hand, thereby releasing the front strap. The skis 312, 322 will be separated, and the skier will now be balancing on the skis accordingly, and utilizing the pole straps located on each pole to ensure that the poles are in hand. The front binding strap can be spooled and stowed, similarly to rear strap.

Another, preferred embodiment of the invention is illustrated in FIGS. 36-57, and can in some ways enhance the performance and efficiency of the skis, poles, and the deep-water reboarding process described above. For example, this embodiment can make it easier for a skier to reboard if they have fallen off their skis in deep water.

The skis 701, 702, shown in FIGS. 36 and 37, respectively, are substantially similar to the skis 10 shown in FIGS. 1-3 and described above except that the connectors 302 have been removed from the ski deck 15. Looking at FIGS. 36 and 37, ski couplings 710 and 711 are each located on one of the sides of each ski, 701, 702. However, the left ski 701 (FIG. 36) has ski coupling 710 towards the bow end with ski coupling 711 being its rearward coupling, while the right ski 702 (FIG. 37) has ski coupling 711 is towards the bow end of with ski coupling 710 being its rearward coupling, thereby making the left ski 701 different from the right ski 702. The left ski 701 has both couplings situated on the right side, or inner side, of the ski 701, while the right ski 702 has both couplings situated on the left side, or inner side, of ski 702, so that the couplings 710, 711 can be mated with one another to connect the skis together.

Figure 41:
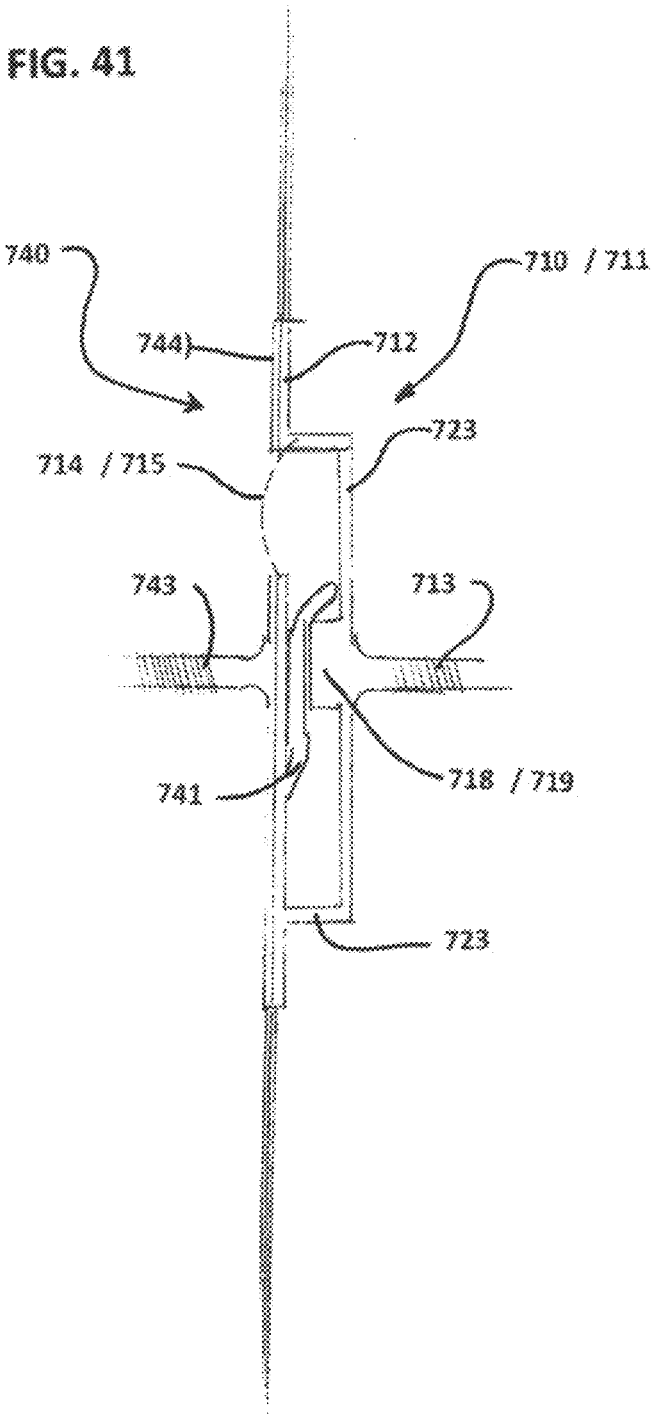
FIG. 41 illustrates an interconnection of a ski coupling to a pole coupling.
Figure 44:
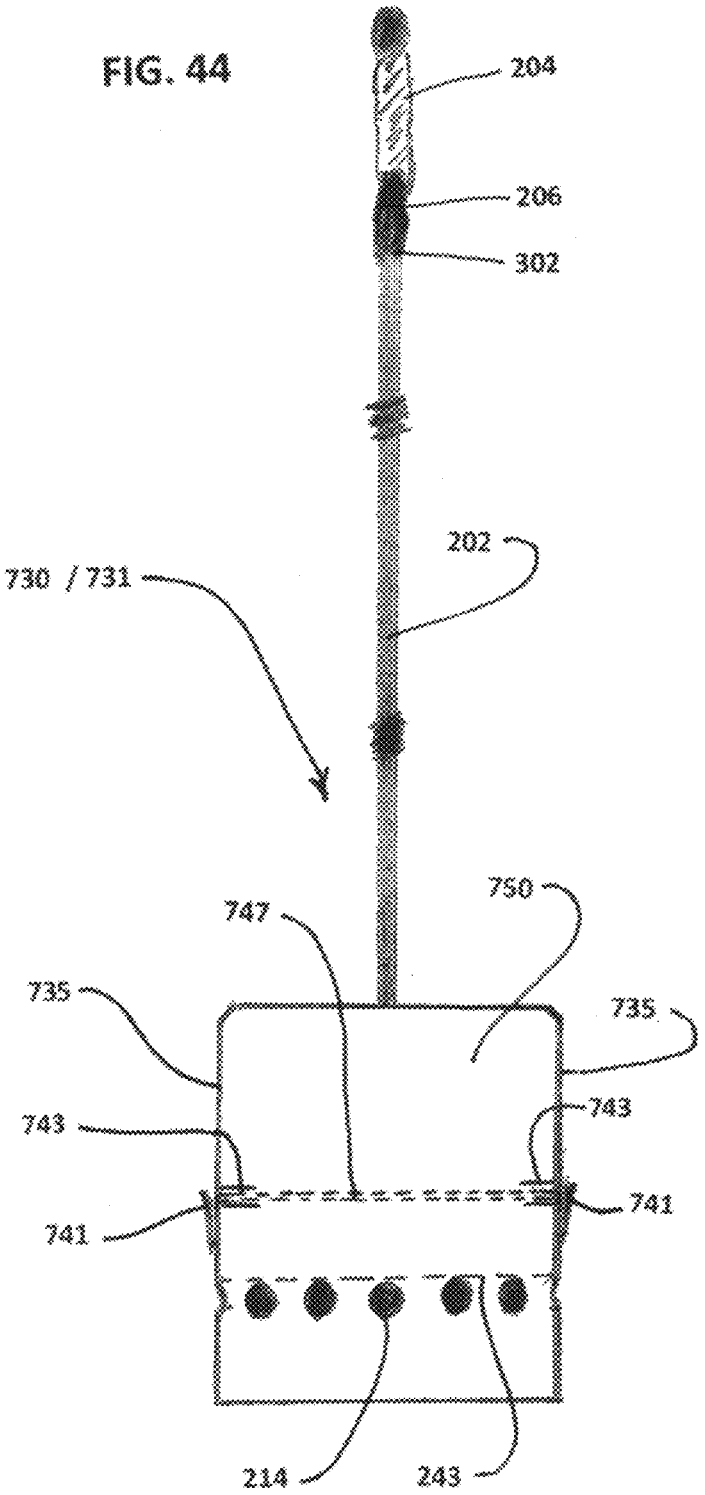
FIG. 44 is a side view of a ski pole according to the present invention.

The ski couplings 710 and 711 shown in FIGS. 36 and 37 are intended for use with an embodiment of a pair of ski poles 730, 731 as shown in FIG. 44. While the ski poles 730, 731 are intended to be substantially identical to each other, pole 730 is designated herein as the "rear" pole when assembling the skis into a "raft formation" during the reboarding process, as will be described below, and pole 731 is designated as the "front" pole, positioned at the front when assembling the raft formation. These indistinguishable ski poles 730, 731 are substantially similar to ski pole 200 as described and as is shown in FIGS. 22-25; except that poles 730 and 731 do not include an upper ring 210, binding strap 242, strap cover 211, or notches 212. Additionally, ski poles 730, 731 include a cylinder 750 with two opposing flat areas 735 and pole couplings 740 attached thereto, as shown in FIGS. 41-43. The reboarding process used with skis 701 and 702 omits having skis 312 and 322 bound by binding straps 334, 344 as described and shown in FIGS. 30-35, and instead involves assembly of the raft by connecting the ski couplings 710, 711 shown in FIGS. 36 and 37 to the pole couplings 740 shown in FIGS. 41-43, and by connecting cross straps 770 to hasps 771 as shown in FIGS. 50-54. The ski couplings 710, 711 and pole couplings 740 as described can enable the ski poles 730, 731 to become quickly connected to the skis 701, 702 in order to configure the equipment into a raft for use during the reboarding process.

Figure 38:
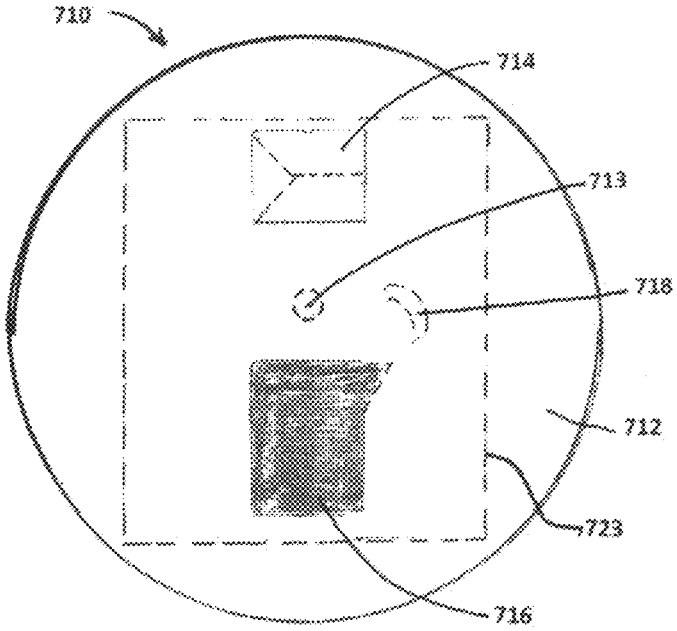
FIG. 38 is a close up view of a ski coupling according to the present invention.

FIG. 38 is a close-up view of ski coupling 710, which may be made of a non-ferrous metal or other rustproof material of suitable strength. It includes a faceplate 712, a location for a boss 713 for mounting to a ski, an outline of a compartment frame 723, a hook tab opening 716 with relief for a hook tab, allowing for clockwise pole rotation during assembly of the skis in a "raft" (as described in more detail below), a flexible tab 714 allowing for clockwise pole rotation during assembly, and a cam 718 positioned for clockwise rotation of the attaching ski pole during assembly.

Figure 39:
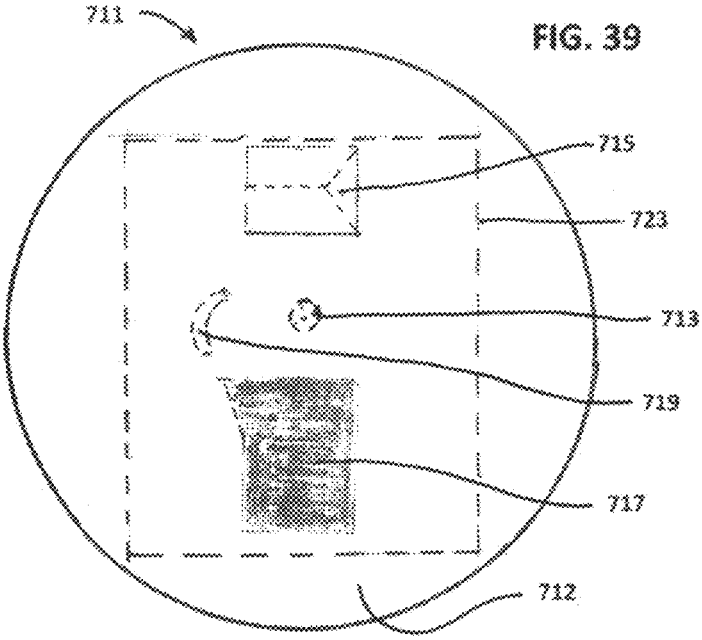
FIG. 39 is a close up view of a ski coupling according to the present invention.

FIG. 39 shows a close-up view of ski coupling 711, which is similar to ski coupling 710 of FIG. 38 but a mirror image thereof, including a faceplate 712, a location of a boss 713 for mounting to a ski, an outline of a compartment frame 723, a hook tab opening 717 with relief for a hook tab, allowing for counter-clockwise pole rotation during assembly of raft, a flexible tab 715 allowing for counter-clockwise pole rotation during assembly, and a cam 719 allowing for counter-clockwise pole rotation during assembly.

Figure 40:
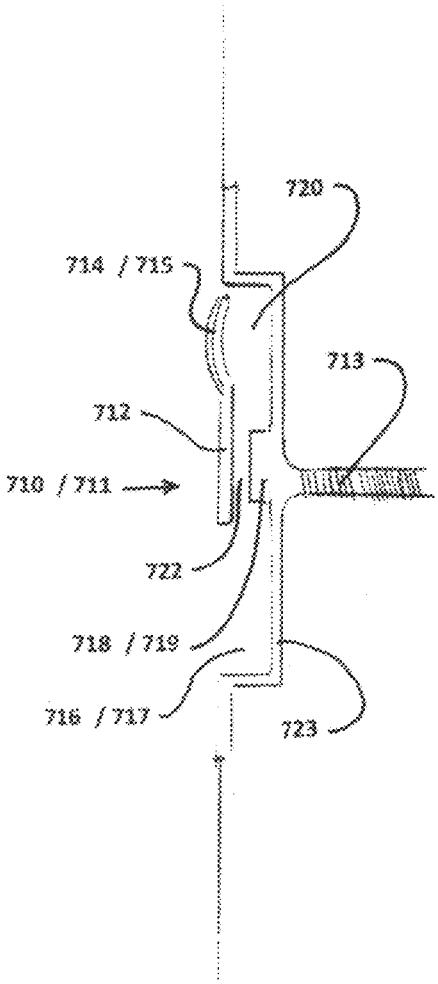
FIG. 40 is a side view of the ski couplings of FIGS. 38 and 39.

FIG. 40 shows a side view of both ski couplings 710, 711 and includes a compartment area 720 within a compartment frame 723. Also shown is a side profile of the flexible tabs 714, 715 and a side profile of the cams 718, 719 indicating the cam position on the inner wall of the back of the compartment frame 723. A gap 722 can be appreciated in FIG. 40, shown between the cam 718, 719 and the faceplate 712 of the ski coupling. The gap 722 provides a space for a hook tab 741, which is a part of the pole coupling 740 as shown in FIGS. 41-44. FIG. 43 is a side view of the pole coupling 740 of FIG. 42, and illustrates the opening for flex tab 742, including its faceplate 744 aligned with a flat area 746 on the ski pole. FIG. 43 also shows the hook tab 741 protruding away from the faceplate 744, creating a gap 745 between hook tab 741 and pole coupling faceplate 744. This gap 745 is sized to receive the ski coupling faceplate 718 when the couplings connect.

FIGS. 42-46 also show a boss 743 which is part of the ski poles 730/731. Initially looking at FIG. 44, it can be appreciated that a boss 743 is present on each side of the ski pole, and each boss may receive a threaded stud 747. This is one method by which the pole couplings 740 may be attached and connected through the pole cylinder 750 of the ski pole. Methods of fabrication, other than a threaded boss and stud connection, are also possible; however, it is imperative to connect each of the opposing pole couplings 740 to each other for the benefit of structural integrity of the pole cylinder 750, enabling it to withstand the rigor of the raft building process.

Figure 45:
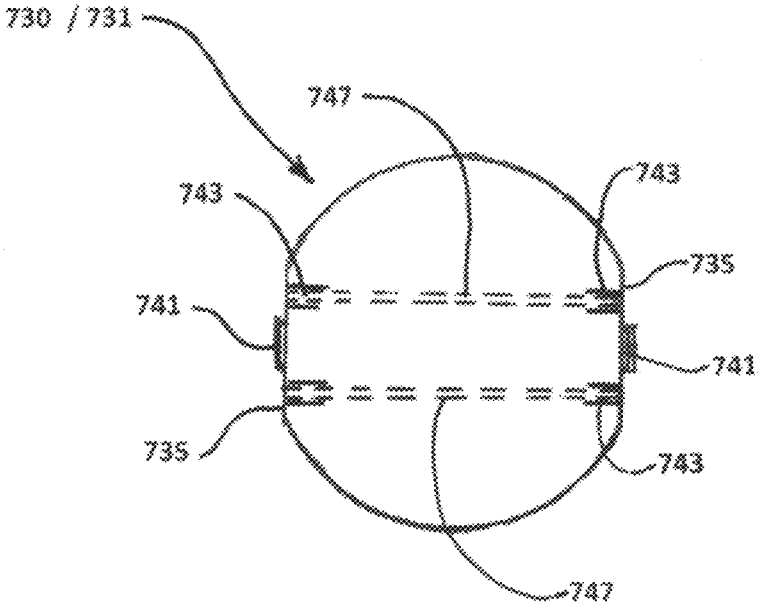
FIG. 45 is a bottom view of the ski pole of FIG. 44.
Figure 46:
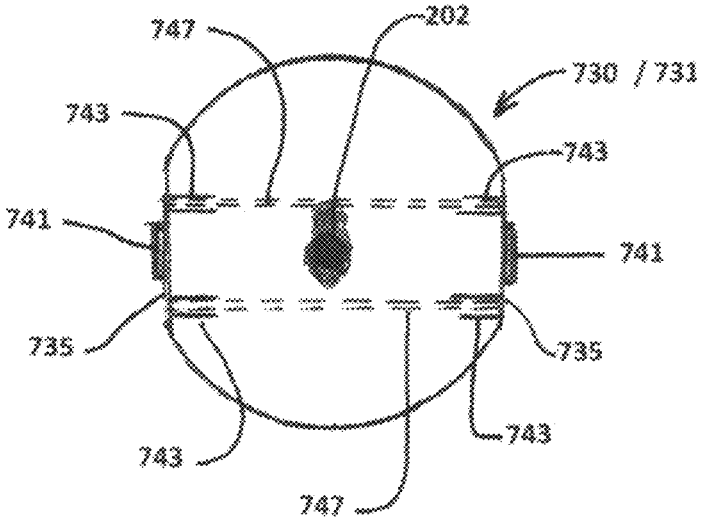
FIG. 46 is a top view of the ski pole of FIG. 44.
Figure 47:
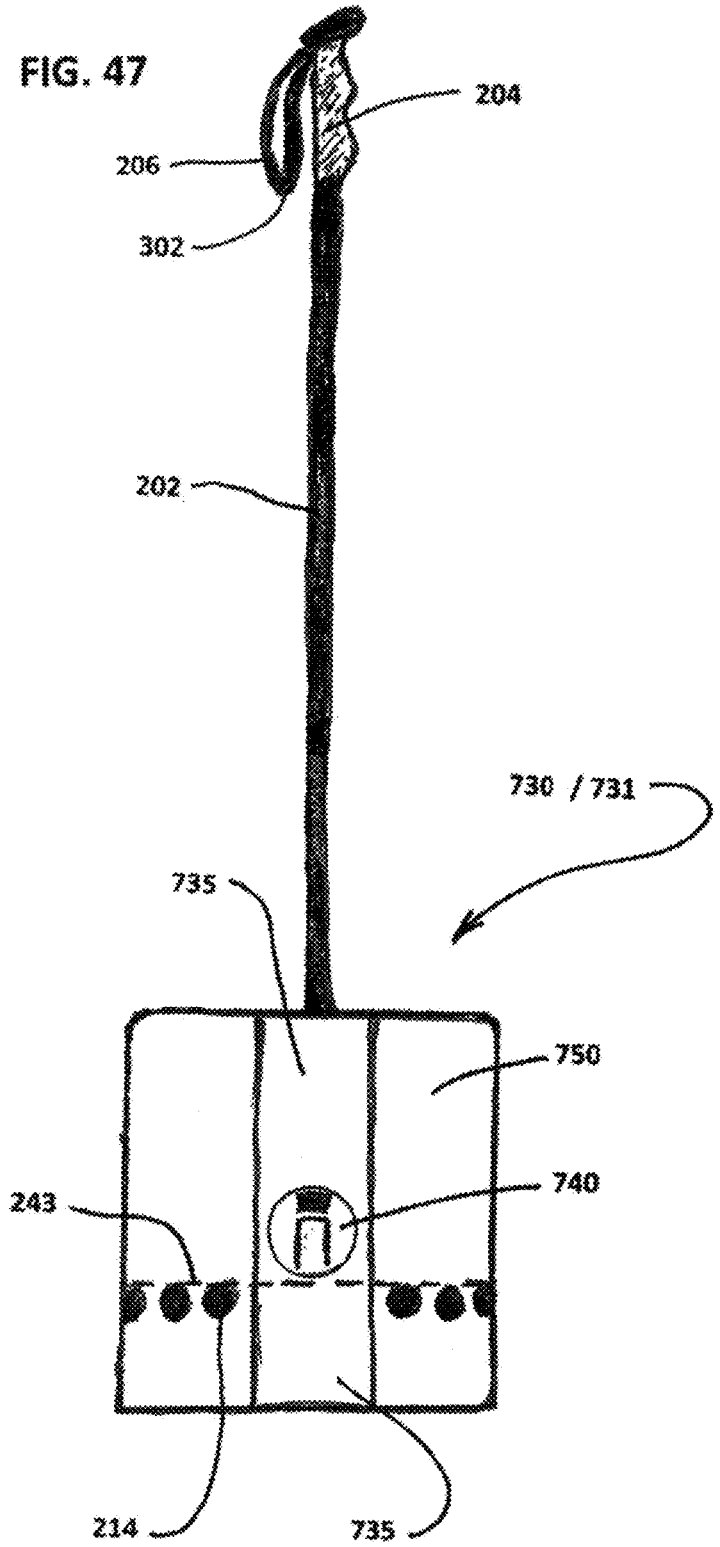
FIG. 47 is a perspective view of the ski pole of FIG. 44.

Looking now at FIG. 41, a side view of the interconnection between the ski coupling 710, 711 with the pole coupling 740 is shown, with the ski coupling being on the right of the pole coupling. Other ski coupling designs and pole coupling designs are possible and may be included as part of the embodiment as they become developed. The ski poles themselves, 730/731, illustrated in FIGS. 44-49, are substantially identical, each being in the form of a cylinder 750 with planar (flat) opposing sides 735, whereby the width of the flat area is approximately 35% of the cylinder diameter. As in embodiment 200 described and illustrated in FIGS. 22-25, the cylinder 750 as seen in FIG. 47 includes a plurality of relief holes 214 positioned equidistant from one another so that as a group they circumscribe the cylinder 750, with the exception that there are no relief holes in the flat areas 735. Similar to the ski pole 200 shown in FIG. 23, the upper portions of the ski pole 730/731 illustrated in FIGS. 44-49 include a shaft 202, a grip 204, a hand strap 206, and a fastener 302.

Figure 48:
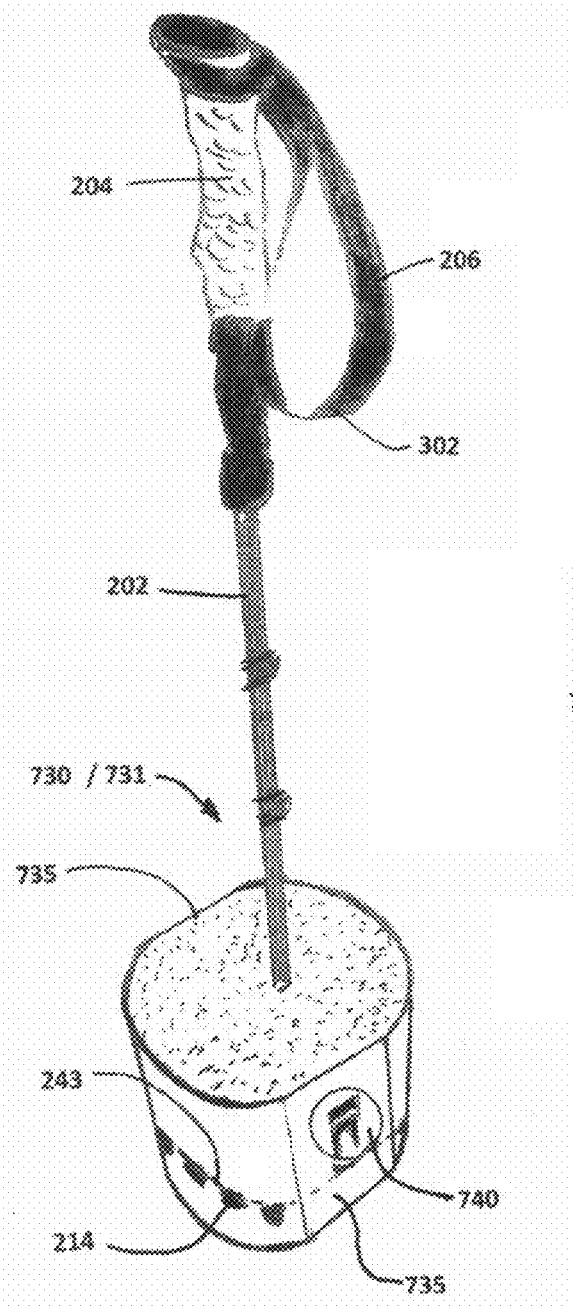
FIG. 48 is a top perspective view of the ski pole of FIG. 44.

FIGS. 47 and 48 illustrate the ski pole 730/731 having a pole coupling 740 included on its flat area 735. The purpose of the flat area 735 is to make the cylinders 750 and their pole couplings 740 compatible with the complementary planar faceplates on the planar sides of the ski couplings 710/711 of the skis 701/702 (see, e.g., FIGS. 36-37). FIG. 44 is a side view of the ski pole after being rotated 90 degrees from FIG. 47, whereby the flat areas 735 of the cylinder 750 are shown on the left and right sides, each side having a protruding pole coupling hook tab 741. Fastening studs 747 are shown in dashed lines in FIGS. 44-46, the studs being threaded into the bosses 743 connecting opposing pole couplings together through the cylinder 750. FIG. 45 is a bottom view of the ski pole, and FIG. 46 is a top view.

Figure 49:
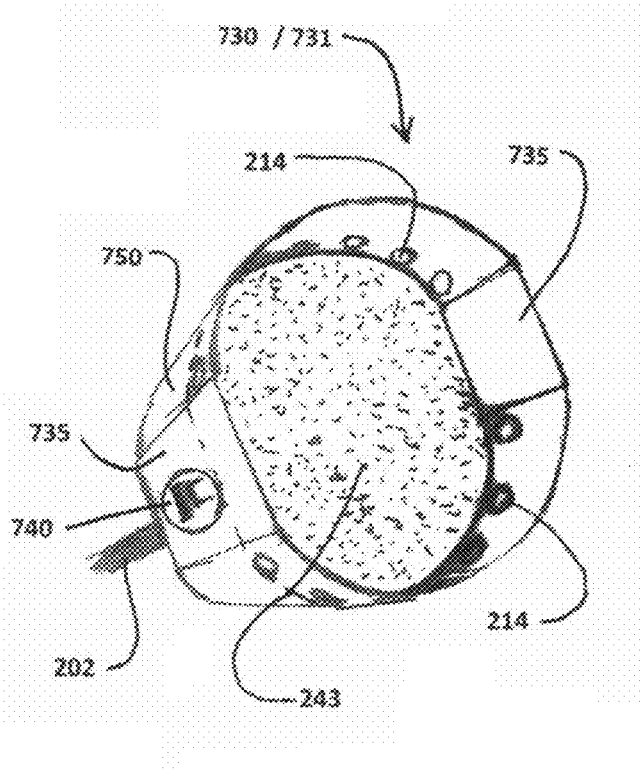
FIG. 49 is a bottom perspective view of the ski pole of FIG. 44.

While FIGS. 47 and 48 illustrate perspective views of the poles 730/731 from the side and from above, respectively. FIG. 49 shows a perspective view of the bottom of the pole, including the delineation 243 circumscribing the cylinder 201, as described above for FIGS. 22-24. The delineation 243 marks the transition to a lower chamber which provides a buoyant undersurface at the bottom of the cylinder. The upper portion of the cylinder can be manufactured to be more buoyant than the lower chamber via hermetical containment, or by encasement of buoyant material such as EPS. The circumscribing air relief holes 214 readily allow air and water to exchange within the undersurface of the cylinder during use, which facilitates the penetration of water by the distal end of the cylinder, thereby preventing it from skating across the water surface, and augmenting the pole's ability to hold its position in the water. This allows the ski pole to provide a moment of balance and control in the water, holding its position, similarly to how a pointed tip on the end of a snow ski pole is inserted into snow or ice, preventing it from skating across the frozen ground surface. The air relief holes 214 can quickly drain as the pole is extracted from the water, preventing water from being held underneath the cylinder, and making it easier for the user to operate them, without wasted energy.

Figure 50:
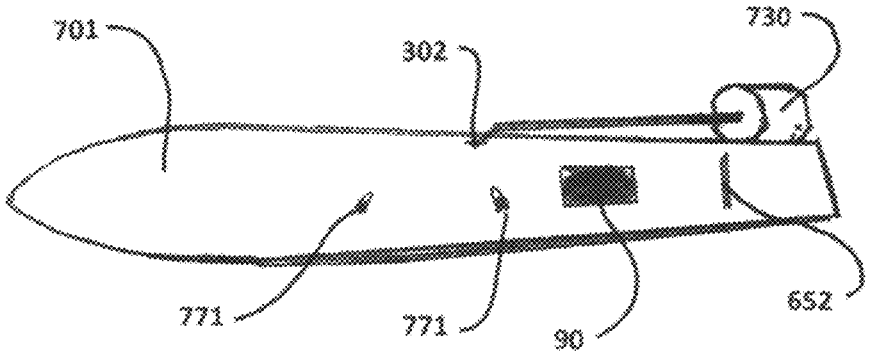
FIG. 50 shows a ski pole attached to a ski for use in the reboarding process.
Figure 51:
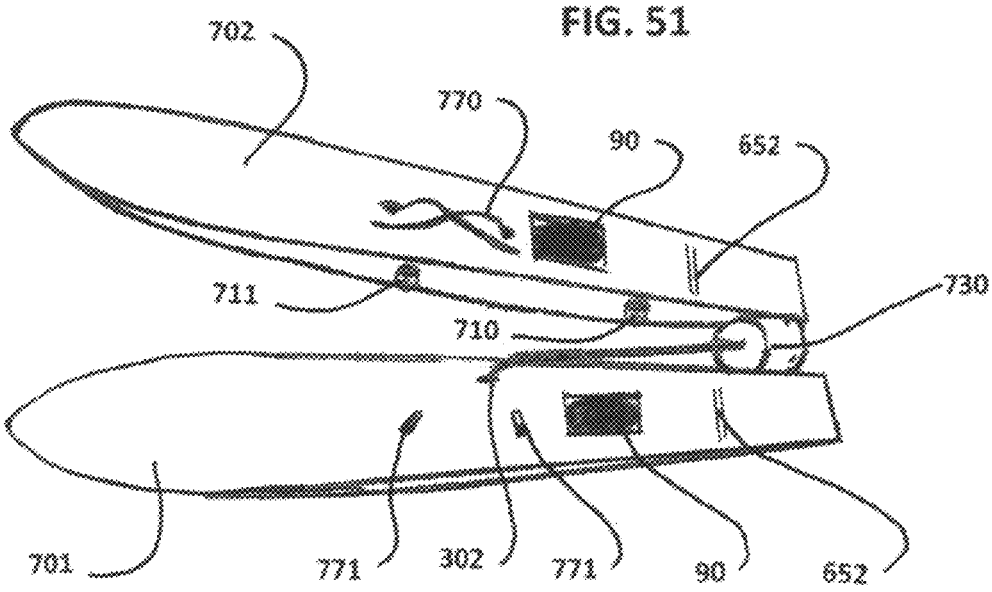
FIG. 51 shows the arrangement of a second ski in the reboarding process.

In the reboarding process for the embodiment of the skis 701/702 and poles 730/731 described herein, the first step is to attach one pole (e.g. pole 730) to one of the skis (e.g. 701), the ski having a suitable fastener 302 mounted on its deck. The fastener 302 is connected to the pole hand strap which includes a complimentary fastener 302, whereby the pole is positioned with its cylinder to the rear of the ski, as illustrated in FIG. 50. The next step is shown in FIG. 51, in which ski 702 (designated here as the right ski) is positioned on the opposite side of pole 730 and oriented in the same direction as ski 701 (the left ski). Ski couplings 710, 711 are now located between the skis.

The next step of the reboarding process for this embodiment is illustrated in FIG. 52, which shows all four pieces of equipment including the second pole 731, the first pole 730 which is floating between the skis 701, 702, its shaft being previously attached to the left ski 701 as described above. The second pole 731 is positioned forward from the first pole 730, between the left ski 701 and right ski 702 in an upright position. Typically, the skier, who is floating in deep water, can position each of the ski poles next to a ski so that the couplings on the ski poles are situated directly opposed to, and face to face with, the complimentary couplings on the skis. See, e.g., FIGS. 50-54. The hook tab 741 of its pole coupling 740 is inserted into the opening 716, 717 in the ski coupling 710, 711 (see FIGS. 38-40 and description above). Once inserted, the ski pole 731 is raised upward, causing its hook tab 741 to compress the faceplate 744 of the ski coupling 710,711 and slip upwards until the flexible tab 714,715 of the ski coupling 710/711 is completely engaged with or lodged within the opening 742 of the pole coupling 740 (see, e.g., FIGS. 41, 43, and their description above). This process is repeated for both skis 701 and 702. The flexible tabs 714, 715 temporarily maintain the assembled items in position, until the components of the "raft" can be more securely connected.

After the flex tabs 714, 715 of both skis are lodged within their respective openings 742 on each side of their ski pole, the skier rotates each pole by its shaft. Specifically, the front ski pole 731 is rotated such that its shaft is canted forward, causing the hook tab 741 to become locked into position and securing both skis to the ski pole 731. The pivot point of rotation is the hook tab 741 within the ski coupling 710/711, as shown in FIG. 41. Such rotation causes the hook tab 741 to slide around the cam 718/719 which is located on the inner back wall of the ski coupling compartment 720, see FIG. 40. The hook tab 741 pivots around the cam 718/719 and gets locked between the cam and the ski coupling faceplate 744 in suitable space 722. As such, the couplings cannot shift side to side, or up and down, and can only become disengaged by counter-rotating the ski pole back to its upright position and pushing downward on the pole to release the flex tab and enabling the pole to be separated from the ski, as will be described in more detail below.

During the process of raft assembly, front pole gets rotated forward and rear pole gets rotated rearward. The differences in design of the ski couplings 710, 711 allow for this method of engagement and disengagement. Therefore, the front ski coupling 710 on left ski 701 is the same as the rear ski coupling 710 on right ski 702, and the rear ski coupling 711 on left ski 701 is the same as front ski coupling 711 on right ski 702. The couplings allow the skis and the ski poles to become connected by the skier in deep water, and conversely allow the skis and the ski poles to become disconnected by skier while they stand on the skis. In addition to the pole couplings keeping the skis together, they can prevent the lower part of the skis from "butterflying" (opening up by rotating), and also can prevent the skis from slipping back and forth.

The final step in binding the equipment together is to connect the two cross-straps 770 to both spring hasps 771. See FIGS. 51-54, and 57. Strap 770 is a nylon strap which has been sewn together in its middle, creating a cross strap. It is permanently attached to deck of right ski 702, while the spring hasps 771 are permanently attached to deck of left ski 701. Each loose end of the cross-strap 770 gets connected to one of the hasps 771 such that the cross-strap becomes taut. The cross strap may include an adjustable component to become shortened or lengthened as needed. The cross strap 770 binds the ski decks together, thereby preventing the skis from "butterflying" (rotating apart at the top) and preventing the skis from slipping back and forth. FIG. 53 illustrates a typical hasp connector 771 and cross-strap 770 that can be used for this embodiment. The contribution of the ski couplings 710/711, ski pole couplings 740, and ski pole hook tabs 741 to the assembly of this embodiment of the "raft" can be found in FIGS. 36-49 and their descriptions, above.

FIG. 54 shows an assembled "raft" for the boarding/reboarding process, following removal of the rear, floating pole 730 from its temporary point of attachment with ski 701 (as shown in FIG. 52) and positioning it upright between the skis, in an area posterior to the foot recesses 90. The rear ski pole 730 is then interconnected to the rear ski couplings 710 and 711 similarly through the method described above, by which pole 731 was interconnected to front ski couplings 710 and 711. The skis 701, 702 and ski poles 730, 731 are thereby presented in FIG. 54 as being securely connected, with the front pole 731 canted forward and rear pole 730 canted rearward. This arrangement is also shown in a water level, side view in FIG. 55. Looking at FIGS. 52 and 54, it can be appreciated that, although the fronts of the skis are already bound tightly together with the second ski pole 730, there is sufficient space between the skis in the rear for the floating pole 731 because that pole had previously been used to space the skis apart, so that the two skis and both of the poles (now upright) can now be bound together. The bound equipment results in a small "raft" having two ski poles between two skis.

Figure 55:
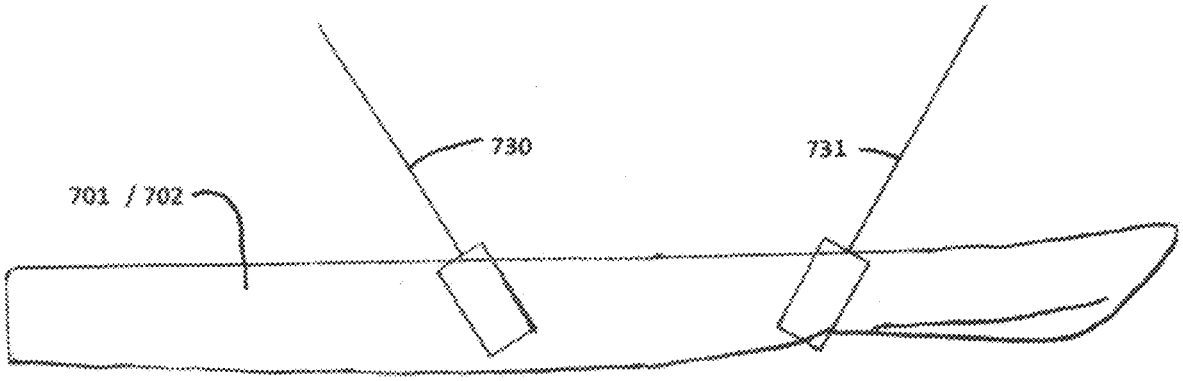
FIG. 55 shows a side view of the assembled "raft"
Figure 56:
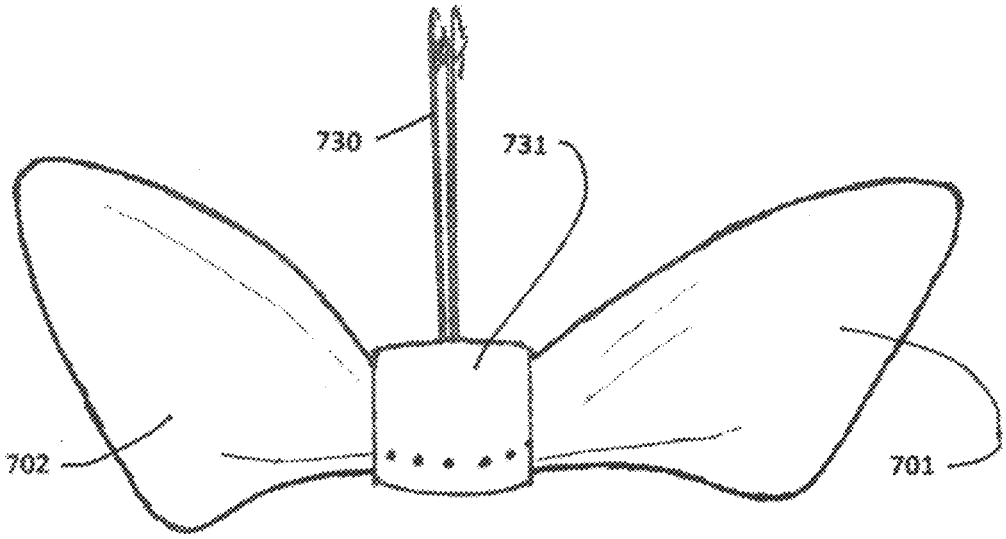
FIG. 56 shows a front, water level view of the assembled "raft"
Figure 57:
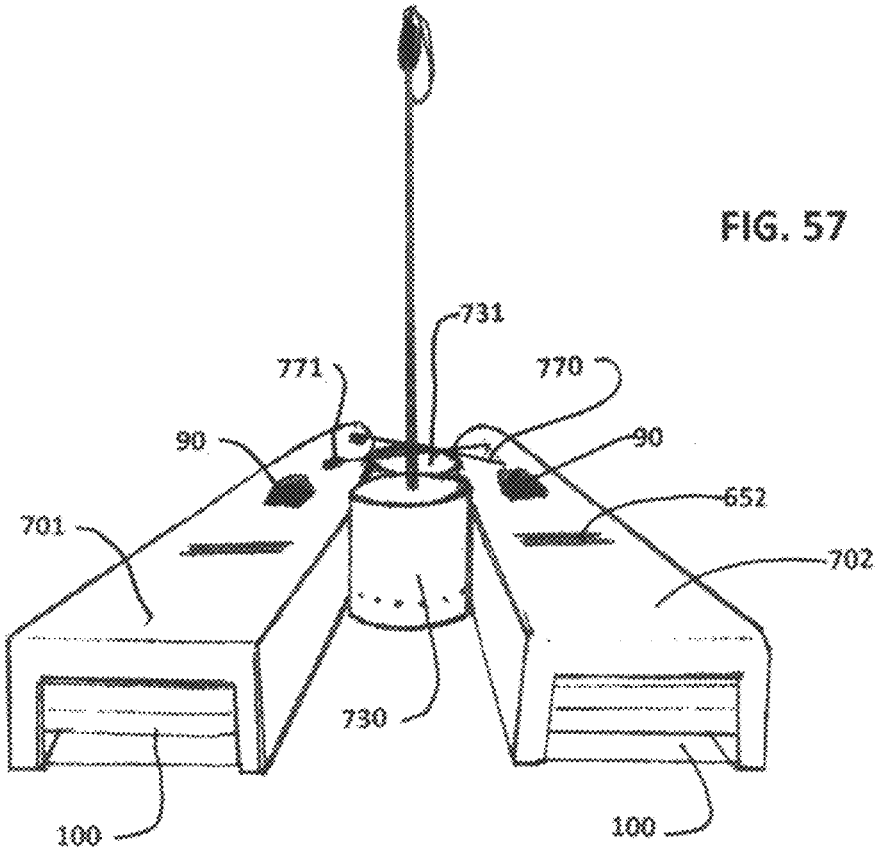
FIG. 57 shows a rear view of the assembled "raft"

FIG. 56 is a view of the front, at water level, of the assembled "raft" of FIG. 54 (showing a top view) and FIG. 55 (showing a side, water level view). The front pole 731 and the shaft of the back pole 730 can be seen situated between the skis 701, 702. The bottoms of the ski pole cylinders are illustrated at a level lower than the bottom of the skis. FIG. 57 is a top perspective rear view of the assembled "raft" showing the rear pole 730 and the front pole 731, both of which are between the two skis 701, 702. The skis are bound by the two cross-straps 770 and their respective spring hasps 771, which are described in more detail below.

Once the "raft" is assembled as described above, the skier who is floating in deep water can easily and safely mount and board the structure. Once the raft is mounted and the skier is initially onboard, the skier can transition from a "hands and knees" position to standing position while securing their feet into the foot recess 90, which can include a waterproof shoe secured to a waterproof binding platform, as described in more detail above. Next, the skier can begin to disassemble the "raft" by relieving and disconnecting the hasps 771 from the cross-strap 770. The skier can then hold and rotate each of the ski poles 730, 731, one at a time, from their canted position to a substantially upright position. When upright, each of the ski poles 730, 731 can then be pushed downward into the water, the forceful movement of which can cause the flexible tabs 714 and 715 to dislodge themselves from the openings 742, and disengage the hook tabs 741 from the faceplates 744, relieving and separating both the pole couplings 740 from the ski couplings 710 and 711. Once the ski poles are disconnected, the skier will be able to resume the skiing position and enjoy skiing.

FIGS. 58-60 illustrate a cape embodiment 500 that can be included for use with the present invention. The purpose of the garment is to be deployed as a "sail", whereby skier stature is the sail mast. It may be fabricated in different sizes, to be worn at the discretion of the skier, and it may also be worn as a sail in other applications, such as on a paddle board. FIG. 58 shows the front of a person wearing cape when not deployed, with it loosely draped over the arms 530. The cape 500 is preferably sewn or otherwise permanently attached to a garment which resembles a sleeveless shirt 501, whereby the sleeveless shirt 501 may be fitted over the user's upper torso, whereby it may fit its user while wearing a life jacket or life vest. The "wings" of the cape can be attachable to each arm 530 of the user, providing freedom of movement, and extending down the user's back to attach just above the user's ankles 505. Elastic loops or "keepers" 506 can be sewn on the cape as means to connect the cape to the ankles and arms.

FIG. 59 shows the user from the front with their arms 530 extended. The sleeveless shirt 501 is fastened in front with a fastening means 507, which can be buttons, snaps, zippers, hook-and-loop, or other state-of-the-art fasteners. Elastic loops or keepers 506 are shown around the wrists and ankles of the user. The cape can be made of a fabric which is lightweight and water-repellant, such as nylon, having reinforced edges and seams 509 and is durable. The cape 500 is designed so that the skier can readily wear it with or without the elastic loops 506 connected to the wrists. This allows flexibility to move the legs while skiing and the safety to swim with it while being worn.

FIG. 60 shows the rear of the user wearing the cape 500 in the deployed position, with their arms extended 502 and the cape extending from the user's shoulders, down the back to above the ankles 505, with the intention to capture wind power. The cape 500 and the shirt 501 preferably have elasticity 508 to fit different size skiers. Legs may be spread apart so that the bottom 504 of the cape is stretched to increase its exposure to wind. Implementation of the cape 500 is most effective while skiing with the wind at the skier's back. The cape is intended to be fun and colorful, and may have pictures and graphics displayed to the enjoyment of the skier. While in use, the aerodynamic effects of the cape can be controlled by twisting the upper body and by arm movement. In one position, the user can rest the pole cylinders on the outer edge of each respective ski, allowing the user to extend their arms to catch wind while simultaneously supporting themselves on the water.

Figure 61:
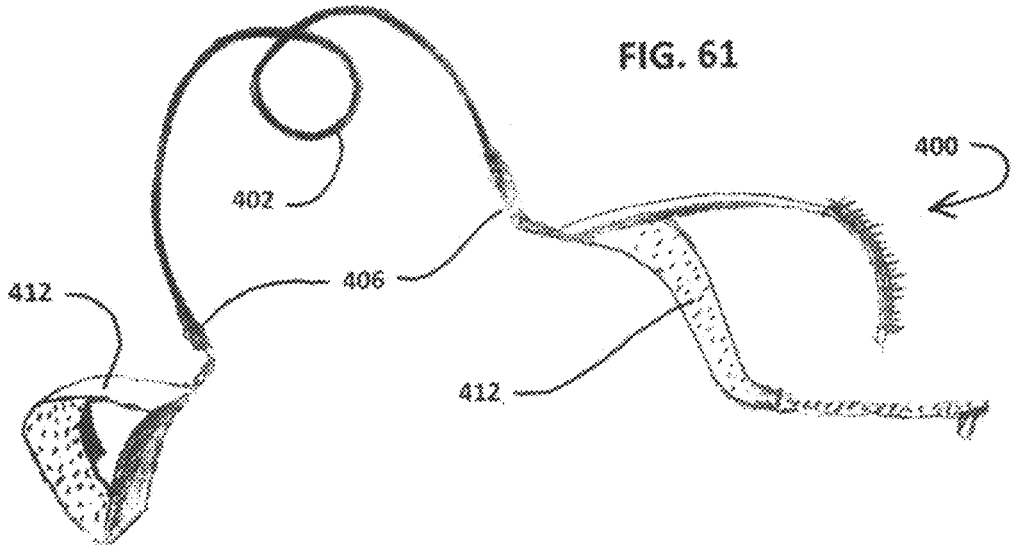
FIG. 61 is a perspective view of a training collar.
Figure 62:
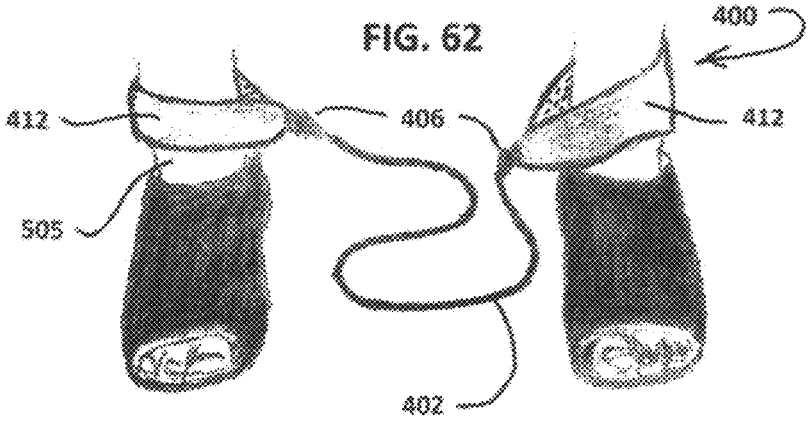
FIG. 62 illustrates wearing the training collar of FIG. 61 in a normal stance.
Figure 63:
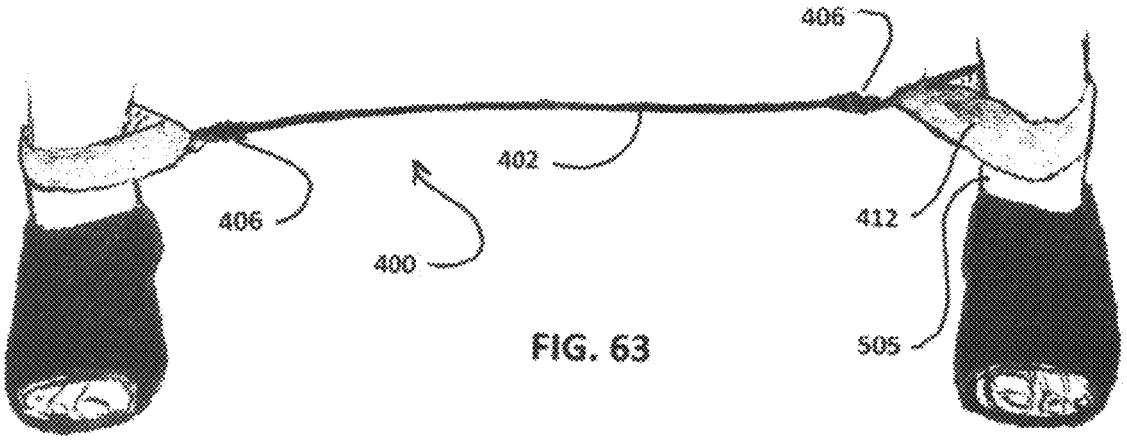
FIG. 63 illustrates wearing the training collar of FIG. 61 in a wide stance.

FIG. 61 shows a training collar 400 that can be included for use with the present invention, to be worn at the discretion of the skier. The training collar provides a measure of confidence and safety by preventing the user's legs from spreading too far apart, while still allowing for necessary and desirable leg movement. The collar 400 can include a tubular cord 402 joined at each end to a pair of foam-lined cuffs 412. Each cuff 412 is joined to the cord by a connecting means 406, and is reversibly attachable around the skier's ankle 505, secured, for example, by a hook-and-loop fastener. The cord 402 is preferably flexible but non-stretchable, and can have a diameter of between about 0.10 inches to 1.0 inches, and preferably about 0.25 inches. FIG. 62 shows the training collar 400 fitted comfortably and secured around the skier's ankles 505 while taking a normal stance, so that the tubular cord 402 is relaxed and slacken and allows walking and skiing leg movement. FIG. 63 shows the training collar 400 fitted comfortably and secured around the skier's ankles 505 while taking a wide stance, so that the tubular cord 402 is stretched to its fullest extent, preventing the skier's legs from spreading too far apart for controlling the skis.

Figure 64:
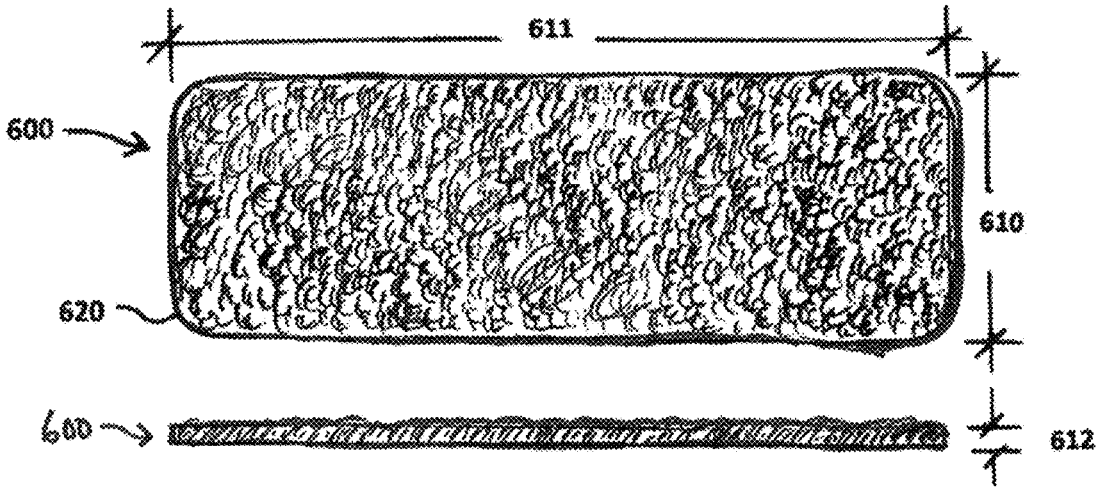
FIG. 64 illustrates a seat for use with the present invention.
Figure 65:
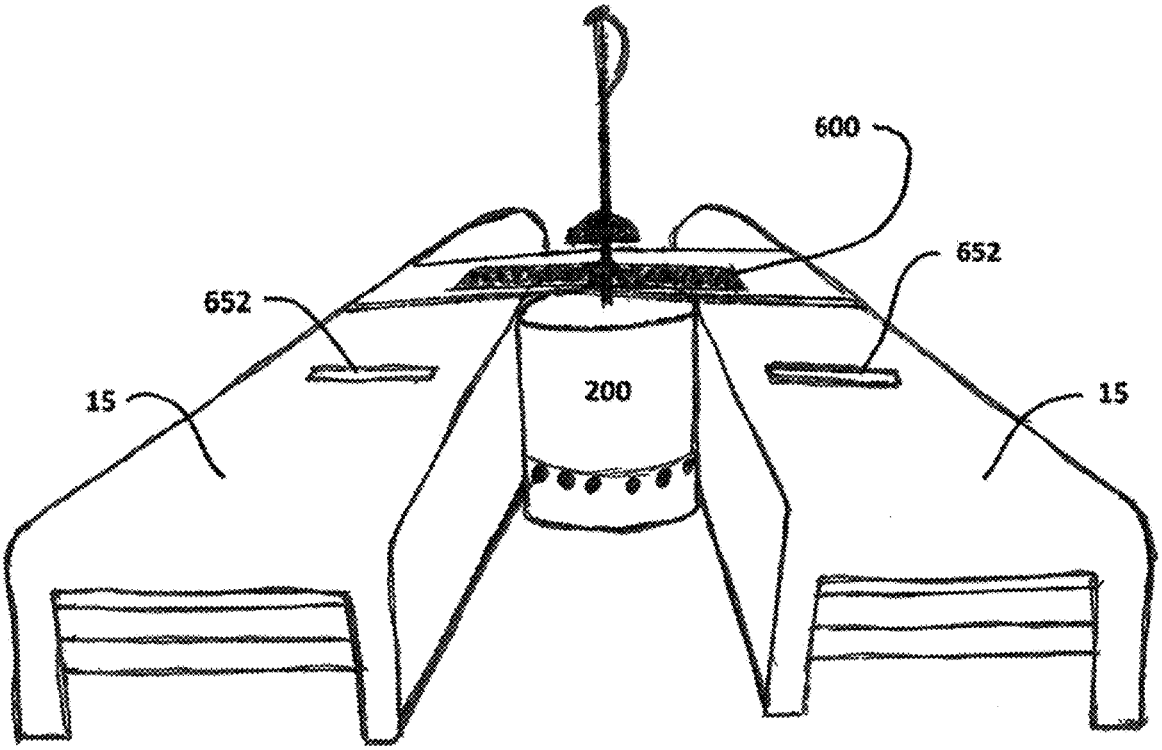
FIG. 65 illustrates the seat, the skis, and the poles bound together as a raft.

FIG. 64 is an illustration of top view and side view of a seat 600 that can be included for use as an accessory piece with the present invention. The seat 600 is buoyant and waterproof, and may be constructed of wood, or foam encased with plastic. FIG. 65 shows the seat 600 centrally located and suspended across the decks of both skis 15, which are bound with poles in a raft configuration, as described in more detail above. The seat is typically planar or nearly planar and may have radially disposed corners 620, and should be of sufficient strength to withstand the weight of the skier, to provide a means to rest and relax while on the water. The seat can be secured to the buckle 652 of each ski via a pliable band. The length 611 of the seat, as shown in FIG. 64, can be between about 15.0 inches to about 30.0 inches, preferably about 24.0 inches. The width 610 of the seat can be between about 5.0 inches and 10.0 inches, preferably about 6.0 inches, and the height or thickness 612 of the seat can be between about 0.25 inches to about 1.0 inches, preferably about 0.5 inches.

The inventive ski and accompanying devices disclosed herein are designed for improved performance, control, and speed while water walking, and encourage the user to experience much more than just standing on the water. The shape of bow assimilates the shape of the front of a boat with single center-ballasted "V" hull, while the stern assimilates the aft shape of a twin catamaran hull. Operationally, the bow facilitates control and maneuverability, allowing the ski to cut through the water and to be more easily directed. The stern facilitates traction, stability, minimizes yawing, minimizes roll, prevents sideway-slippage for safety, and allows the ski to trail and stay on track. The streamlined and sleek design of the inventive ski minimizes water cohesion and reduces drag and resistance. Each ski includes a plurality of traction gates 100 which enable water to flow freely through a tunnel within the ski when the gates 100 are open, and conversely to entrap and contain water within the ski when the gates are closed.

The ski poles disclose herein can facilitate skier balance and movement, and can also be used during the deep-water boarding/reboarding process. The lower chambers of the ski poles can prevent skating and allow the poles to be easily extracted from the water. The lower chambers can also hold their position when inserted into water to greatly benefit skier movement and balance. The cylindrical design of the poles allow them to be operated without regard for front, back or side orientation.

While the present invention is illustrated by the description of particular embodiments in considerable detail, such detail is not intended to restrict or limit the scope of the appended claims. Additional advantages and modifications will be readily apparent to those skilled in the art without departing from the concept or scope of the invention.

What is claimed is:

1. A water walking ski comprising:

a) an elongated body having a bow end in the form of a monohull and a stern end in the form of a twin hull, the elongated body further including a top deck and a recessed area for foot placement within the top deck;

b) two parallel side extensions which protrude downward from the top deck;

c) a bottom cover located beneath the top deck and between the parallel side extensions, wherein the top deck, the side extensions, and the bottom cover together form a tunnel, the tunnel including a first opening near the bow end for admitting water and a second opening near the stern end for expelling water; and d) a plurality of traction gates spaced apart from one another and mounted within the tunnel, wherein each of the plurality of traction gates permits water flow through the tunnel from the bow end to the stern end when the ski moves forward while closing to prevent water flow when moving in the reverse direction, and wherein water cannot pass through the second opening and is contained within the tunnel when the traction gates are closed.

2. The water walking ski of claim 1, wherein each of the plurality of traction gates comprises a frame and a plurality of diagonally oriented louvers, each louver being hingedly mounted within the frame by way of an axle, wherein each of the plurality of louvers can together move between an open position which allows water to pass through the gate, to a closed position in which the louvers partially overlap one another to prevent water passage through the gate.

3. The water walking ski of claim 2, further comprising a plurality of gate vents located within the bottom cover, wherein each of the plurality of gate vents are located proximal to a corresponding traction gate for allowing water to pass into and out of the traction gates, thereby ensuring that an adequate amount of water is present within each traction gate when the traction gates are closed, while minimizing impediment of water flow when the traction gates are open.

4. The water walking ski of claim 3, wherein the gate vents are covered by screens to prevent unwanted debris from entering the tunnel.

5. The water walking ski of claim 1, wherein the bow end occupies approximately 30% of the total body length, and the stern end occupies approximately 70% of the total body length.

6. The water walking ski of claim 1, wherein a screen covers the first opening of the ski to prevent unwanted debris such as seaweed or driftwood from entering the interior of the ski.

7. The water walking ski of claim 1, wherein the bottom of the side extensions and the cover differ in elevation to allow the ski to rest on its side extensions when on solid land.

8. The water walking ski of claim 1, wherein the recessed area is centrally located in the body of the ski.

9. A water walking apparatus, comprising:

a) a pair of water walking skis, each water walking ski comprising:

i) an elongated body having a bow end in the form of a monohull and a stern end in the form of a twin hull, the elongated body further including a top deck and a recessed area for foot placement within the top deck;

ii) two parallel side extensions which protrude downward from the top deck;

iii) a bottom cover located beneath the top deck and between the parallel side extensions, wherein the top deck, the side extensions, and the bottom cover together form a tunnel, the tunnel including a first opening near the bow end for admitting water and a second opening near the stern end for expelling water; and iv) a plurality of traction gates spaced apart from one another and mounted within the tunnel, wherein each of the plurality of traction gates permits water flow through the tunnel from the bow end to the stern end when the ski moves forward while closing to prevent water flow when moving in the reverse direction, and wherein water cannot pass through the second opening and is contained within the tunnel when the traction gates are closed.

10. The water walking apparatus of claim 9, further comprising a pair of ski poles for balance, each ski pole comprising:

i. a shaft including a grip and a pole strap located at the top of the shaft, the pole strap including a fastener; and ii. a cylinder radially attached to the bottom of the shaft.

11. The water walking apparatus of claim 10, wherein the cylinder includes:

1) a pair of notches located opposite one another at the bottom of the cylinder;

2) a plurality of air relief holes positioned equidistant from one other between the notches;

3) a binding strap attached to the top of the cylinder for binding the skis and poles together;

4) a pair of bevel recesses located opposite one another at the top of the cylinder, each bevel recess being vertically aligned with one of the pair of notches located at the bottom of the cylinder; and 5) a lower chamber which provides an open ended compartment beneath the undersurface of the cylinder, wherein the shaft is connected to the cylinder without penetrating the lower chamber.

12. The water walking apparatus of claim 9, wherein each of the plurality of traction gates comprises a frame and a plurality of diagonally oriented louvers, each louver being hingedly mounted within the frame by way of an axle, wherein each of the plurality of louvers can together move between an open position which allows water to pass through the gate, to a closed position in which the louvers partially overlap one another to prevent water passage through the gate.

13. The water walking apparatus of claim 9, each water walking ski further comprising a plurality of gate vents located within the bottom cover, wherein each of the plurality of gate vents are located proximal to a corresponding traction gate for allowing water to pass into and out of the traction gates, thereby ensuring that an adequate amount of water is present within each traction gate when the traction gates are closed, while minimizing impediment of water flow when the traction gates are open.

14. The water walking ski of claim 13, wherein the gate vents are covered by screens to prevent unwanted debris from entering the tunnel.

15. The water walking apparatus of claim 9, wherein the bow end of each ski occupies approximately 30% of the total body length, and the stern end occupies approximately 70% of the total body length.

16. The water walking apparatus of claim 9, wherein a screen covers the first opening of each ski to prevent unwanted debris such as seaweed or driftwood from entering the interior of the ski.

17. The water walking apparatus of claim 9, wherein in each ski the bottom of the side extensions and the cover differ in elevation to allow the ski to rest on its side extensions when on solid land.

18. The water walking ski of claim 9, wherein the recessed area of each ski is centrally located in the body of the ski.

19. A method for boarding and/or reboarding a pair of water walking skis in deep water, the method comprising the steps of:

a) providing a water walking apparatus, the water walking apparatus comprising a pair of water walking skis and a pair of ski poles, each water walking ski comprising:
   1) an elongated body having a bow end in the form of a monohull and a stern end in the form of a twin hull, the elongated body further including a top deck and a recessed area for foot placement within the top deck;
   2) two parallel side extensions which protrude downward from the top deck;
   3) a bottom cover located beneath the top deck and between the parallel side extensions, wherein the top deck, the side extensions, and the bottom cover together form a tunnel, the tunnel including a first opening near the bow end for admitting water and a second opening near the stern end for expelling water; and
   4) a plurality of traction gates mounted within the tunnel, wherein each of the plurality of traction gates permits water flow through the tunnel from the bow end to the stern end when the ski moves forward while closing to prevent water flow when moving in the reverse direction, and wherein water cannot pass through the second opening and is contained within the tunnel when the traction gates are closed; each ski pole comprising:
      i) a shaft including a grip and a pole strap located at the top of the shaft, the pole strap including a fastener; and
      ii) a cylinder radially attached to the bottom of the shaft, the cylinder including a binding strap for binding the skis and poles together;

b) gathering the skis and poles;

c) binding the skis and poles into a raft-like unit with the binding straps;

d) climbing aboard the raft;

e) maneuvering to an upright position;

f) unbinding skis and poles;

g) stowing the binding straps; and h) using the water walking skis for efficient, self-propelled travel across the water by moving in a similar manner as cross-country snow skiing.

* * * * *